US012790920B2

(12) United States Patent
Preiss et al.

(10) Patent No.: US 12,790,920 B2
(45) Date of Patent: Nov. 10, 2026

(54) PERFORATING GUN ORIENTATION SYSTEM

(71) Applicant: DynaEnergetics Europe GmbH, Troisdorf (DE)

(72) Inventors: Frank Haron Preiss, Bonn (DE); Thilo Scharf, Letterkenny (IE); Liam McNelis, Bonn (DE); Eric Mulhern, Edmonton (CA); David C. Parks, Calgary (CA); Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 103 days.

(21) Appl. No.: 18/790,983

(22) Filed: Jul. 31, 2024

(65) Prior Publication Data

US 2024/0392662 A1 Nov. 28, 2024

Related U.S. Application Data

(60) Continuation of application No. 17/875,585, filed on Jul. 28, 2022, now Pat. No. 12,078,038, which is a (Continued)

(30) Foreign Application Priority Data

Jul. 18, 2013 (CA) ..... CA 2821506

(51) Int. Cl.
*F42D 1/02* (2006.01)
*E21B 43/1185* (2006.01)
(Continued)

(52) U.S. Cl.
CPC .... *E21B 43/1185* (2013.01); *E21B 43/11855* (2013.01); *E21B 43/119* (2013.01);
(Continued)

(58) Field of Classification Search
CPC ..... F42D 1/02; E21B 43/11855
See application file for complete search history.

(56) References Cited

U.S. PATENT DOCUMENTS 2,216,359 A 10/1940 Spencer
2,228,873 A 1/1941 Hardt et al.
(Continued)

FOREIGN PATENT DOCUMENTS

AU 2010217183 B2 6/2016
CA 288787 A 4/1929
(Continued)

OTHER PUBLICATIONS

Dynaenergetics Europe GMBH; Complaint and Demand for Jury Trial for Civil Action No. 4:21-cv-00280; dated Jan. 28, 2021; 55 pages.

(Continued)

*Primary Examiner* — J. Woodrow Eldred
(74) *Attorney, Agent, or Firm* — Womble Bond Dickinson (US) LLP

(57) ABSTRACT

A charge holder for use with a shaped charge may include a charge receiving structure configured to receive the shaped charge, a plurality of projections extending from the charge receiving structure and configured to retain the shaped charge within the charge receiving structure, and a rotation coupling configured to couple to an adjacent charge holder.

20 Claims, 18 Drawing Sheets

Related U.S. Application Data continuation of application No. 17/352,728, filed on Jun. 21, 2021, now Pat. No. 11,661,823, which is a continuation of application No. 17/221,219, filed on Apr. 2, 2021, now Pat. No. 11,788,389, which is a continuation of application No. 17/007,574, filed on Aug. 31, 2020, now Pat. No. 11,542,792, which is a continuation of application No. 16/809,729, filed on Mar. 5, 2020, now Pat. No. 11,608,720, which is a continuation of application No. 16/585,790, filed on Sep. 27, 2019, now Pat. No. 10,844,697, which is a continuation of application No. 16/359,540, filed on Mar. 20, 2019, now Pat. No. 10,472,938, which is a continuation of application No. 15/920,812, filed on Mar. 14, 2018, now Pat. No. 11,125,056, which is a continuation of application No. 15/617,344, filed on Jun. 8, 2017, now Pat. No. 10,429,161, which is a division of application No. 15/287,309, filed on Oct. 6, 2016, now Pat. No. 9,702,680, which is a division of application No. 14/904,788, filed as application No. PCT/CA2014/050673 on Jul. 16, 2014, now Pat. No. 9,494,021.

(51) Int. Cl.
*E21B 43/119* (2006.01)
*F42C 19/06* (2006.01)
*F42D 1/04* (2006.01)

(52) U.S. Cl.
CPC ..... *F42C 19/06* (2013.01); *F42D 1/02* (2013.01); *F42D 1/04* (2013.01); *F42D 1/043* (2013.01)

(56) References Cited

U.S. PATENT DOCUMENTS 2,296,346 A 9/1942 Hearn
2,326,406 A 8/1943 Lloyd
2,358,466 A 9/1944 Miller
2,418,486 A 4/1947 Smylie
2,439,394 A 4/1948 Lanzalotti et al.
2,519,116 A 8/1950 Crake
2,543,814 A 3/1951 Thompson et al.
2,598,651 A 5/1952 Spencer
2,621,744 A 12/1952 Toelke
2,644,530 A 7/1953 Baker
2,655,993 A 10/1953 Lloyd
2,696,258 A 12/1954 Greene
2,734,456 A 2/1956 Sweetman
2,742,857 A 4/1956 Turechek
2,755,863 A 7/1956 Stansbury et al.
2,785,631 A 3/1957 Blanchard
2,799,343 A 7/1957 Conrad
2,821,136 A 1/1958 Castel
2,889,775 A 6/1959 Owen
2,906,339 A 9/1959 Griffin
2,946,283 A 7/1960 Udry
2,982,210 A 5/1961 Andrew et al.
3,040,659 A 6/1962 Mcculleugh
RE25,407 E 6/1963 Lebourg
3,125,024 A 3/1964 Hicks et al.
3,155,164 A 11/1964 Keener
3,158,680 A 11/1964 Lovitt et al.
3,170,400 A 2/1965 Nelson
3,173,992 A 3/1965 Boop
RE25,846 E 8/1965 Campbell
3,208,378 A 9/1965 Boop
3,246,707 A 4/1966 Bell
3,264,989 A 8/1966 Rucker
3,264,994 A 8/1966 Kurt
3,303,884 A 2/1967 Medford
3,336,054 A 8/1967 Blount et al.
3,374,735 A 3/1968 Moore
3,426,849 A 2/1969 Brumble, Jr.
3,426,850 A 2/1969 Mcduffie, Jr.
3,444,810 A 5/1969 Hakala
3,504,723 A 4/1970 Cushman et al.
3,565,188 A 2/1971 Hakala
3,859,921 A 1/1975 Stephenson
4,007,790 A 2/1977 Henning
4,007,796 A 2/1977 Boop
4,039,239 A 8/1977 Cobaugh et al.
4,058,061 A 11/1977 Mansur, Jr. et al.
4,100,978 A 7/1978 Boop
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,191,265 A 3/1980 Bosse-Platiere
4,208,966 A 6/1980 Hart
4,220,087 A 9/1980 Posson
4,234,768 A 11/1980 Boop
4,266,613 A 5/1981 Boop
4,290,486 A 9/1981 Regalbuto
4,312,273 A 1/1982 Camp
4,363,529 A 12/1982 Loose
4,411,491 A 10/1983 Larkin et al.
4,457,383 A 7/1984 Boop
4,479,556 A 10/1984 Stout et al.
4,479,584 A 10/1984 Raz
4,485,741 A 12/1984 Moore et al.
4,491,185 A 1/1985 McClure
4,496,008 A 1/1985 Pottier et al.
4,512,418 A 4/1985 Regalbuto et al.
4,519,313 A 5/1985 Leidel
4,523,649 A 6/1985 Stout
4,523,650 A 6/1985 Sehnert et al.
4,534,423 A 8/1985 Regalbuto
4,574,892 A 3/1986 Grigar et al.
4,598,775 A 7/1986 Vann et al.
4,609,057 A 9/1986 Walker et al.
4,621,396 A 11/1986 Walker et al.
4,629,001 A 12/1986 Miller et al.
4,635,734 A 1/1987 Donovan et al.
4,643,097 A 2/1987 Chawla et al.
4,650,009 A 3/1987 McClure et al.
4,657,089 A 4/1987 Stout
4,660,910 A 4/1987 Sharp et al.
4,730,793 A 3/1988 Thurber, Jr. et al.
4,744,424 A 5/1988 Lendermon et al.
4,747,201 A 5/1988 Donovan et al.
4,753,170 A 6/1988 Regalbuto et al.
4,762,067 A 8/1988 Barker et al.
4,776,393 A 10/1988 Forehand et al.
4,790,383 A 12/1988 Savage et al.
4,796,708 A 1/1989 Lembcke
4,800,815 A 1/1989 Appledorn et al.
4,817,531 A 4/1989 Walker et al.
4,832,134 A 5/1989 Gill
4,852,494 A 8/1989 Williams
4,869,171 A 9/1989 Abouav
4,889,183 A 12/1989 Sommers et al.
4,919,050 A 4/1990 Dobrinski et al.
5,006,833 A 4/1991 Marlowe et al.
5,027,708 A 7/1991 Gonzalez et al.
5,033,553 A 7/1991 Miszewski et al.
5,038,682 A 8/1991 Marsden
5,040,619 A 8/1991 Jordan et al.
5,052,489 A 10/1991 Carisella et al.
5,060,573 A 10/1991 Montgomery et al.
5,088,413 A 2/1992 Huber
5,105,742 A 4/1992 Sumner
5,159,145 A 10/1992 Carisella et al.
5,159,146 A 10/1992 Carisella et al.
5,204,491 A 4/1993 Aureal et al.
5,237,136 A 8/1993 Langston
5,241,891 A 9/1993 Hayes et al.
5,322,019 A 6/1994 Hyland
5,323,684 A 6/1994 Umphries
5,334,801 A 8/1994 Mohn

(56) References Cited

U.S. PATENT DOCUMENTS 5,347,929 A 9/1994 Lerche et al.
5,358,418 A 10/1994 Carmichael
5,379,845 A 1/1995 Blount et al.
5,392,851 A 2/1995 Arend
5,392,860 A 2/1995 Ross
5,436,791 A 7/1995 Turano et al.
5,503,077 A 4/1996 Motley
5,531,164 A 7/1996 Mosley
5,564,499 A 10/1996 Willis et al.
5,603,384 A 2/1997 Bethel et al.
5,648,635 A 7/1997 Lussier et al.
5,671,899 A 9/1997 Nicholas et al.
5,703,319 A 12/1997 Fritz et al.
5,756,926 A 5/1998 Bonbrake et al.
5,775,426 A 7/1998 Snider et al.
5,778,979 A 7/1998 Burleson et al.
5,785,130 A 7/1998 Wesson et al.
5,791,914 A 8/1998 Loranger et al.
5,803,175 A 9/1998 Myers, Jr. et al.
5,816,343 A 10/1998 Markel et al.
5,820,402 A 10/1998 Chiacchio et al.
5,823,266 A 10/1998 Burleson et al.
5,837,925 A 11/1998 Nice
5,911,277 A 6/1999 Hromas et al.
5,964,294 A 10/1999 Edwards et al.
5,992,289 A 11/1999 George et al.
6,006,833 A 12/1999 Burleson et al.
6,012,525 A 1/2000 Burleson et al.
6,014,933 A 1/2000 Umphries et al.
6,056,058 A 5/2000 Gonzalez
6,070,662 A 6/2000 Ciglenec et al.
6,112,666 A 9/2000 Murray et al.
6,263,283 B1 7/2001 Snider et al.
6,269,875 B1 8/2001 Harrison, III et al.
6,297,447 B1 10/2001 Burnett et al.
6,298,915 B1 10/2001 George
6,305,287 B1 10/2001 Capers et al.
6,315,461 B1 11/2001 Cairns
6,333,699 B1 12/2001 Zierolf
6,354,374 B1 3/2002 Edwards et al.
6,378,438 B1 4/2002 Lussier et al.
6,385,031 B1 5/2002 Lerche et al.
6,386,108 B1 5/2002 Brooks et al.
6,397,947 B1 6/2002 Behrmann et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,464,511 B1 10/2002 Watanabe et al.
6,467,415 B2 10/2002 Menzel et al.
6,474,931 B1 11/2002 Austin et al.
6,487,973 B1 12/2002 Gilbert, Jr. et al.
6,497,285 B2 12/2002 Walker
6,506,083 B1 1/2003 Bickford et al.
6,520,258 B1 2/2003 Yang et al.
6,582,251 B1 6/2003 Burke et al.
6,595,290 B2 * 7/2003 George ..... E21B 43/116 166/255.2
6,618,237 B2 9/2003 Eddy et al.
6,651,747 B2 11/2003 Chen et al.
6,659,180 B2 12/2003 Moss
6,675,896 B2 1/2004 George
6,719,061 B2 4/2004 Muller et al.
6,739,265 B1 5/2004 Badger et al.
6,742,602 B2 6/2004 Trotechaud
6,752,083 B1 6/2004 Lerche et al.
6,773,312 B2 8/2004 Bauer et al.
6,776,668 B1 8/2004 Scyoc et al.
6,779,605 B2 8/2004 Jackson
6,822,542 B2 11/2004 Clark et al.
6,837,310 B2 1/2005 Martin
6,843,317 B2 1/2005 Mackenzie
6,851,471 B2 2/2005 Barlow et al.
6,851,476 B2 2/2005 Gray et al.
6,902,414 B2 6/2005 Dopf et al.
7,013,977 B2 3/2006 Nordaas
7,044,230 B2 5/2006 Starr et al.
7,074,064 B2 7/2006 Wallace
7,093,664 B2 8/2006 Todd et al.
7,104,323 B2 9/2006 Cook et al.
7,107,908 B2 9/2006 Forman et al.
7,114,564 B2 10/2006 Parrott et al.
7,147,068 B2 12/2006 Vail, III
7,168,494 B2 1/2007 Starr et al.
7,182,625 B2 2/2007 Machado et al.
7,193,156 B2 3/2007 Alznauer et al.
7,193,527 B2 3/2007 Hall
7,210,524 B2 5/2007 Sloan et al.
7,234,521 B2 6/2007 Shammai et al.
7,237,626 B2 7/2007 Gurjar et al.
7,243,722 B2 7/2007 Oosterling et al.
7,278,491 B2 10/2007 Scott
7,297,004 B1 11/2007 Shuhart et al.
7,306,038 B2 12/2007 Challacombe
7,347,278 B2 3/2008 Lerche et al.
7,347,279 B2 * 3/2008 Li ..... E21B 43/117 175/4.6
7,350,448 B2 4/2008 Bell et al.
7,353,879 B2 4/2008 Todd et al.
7,357,083 B2 4/2008 Takahara et al.
7,360,487 B2 4/2008 Myers, Jr. et al.
7,364,451 B2 4/2008 Ring et al.
7,387,162 B2 6/2008 Mooney, Jr. et al.
7,404,725 B2 7/2008 Hall et al.
7,441,601 B2 10/2008 George et al.
7,455,104 B2 11/2008 Duhon et al.
7,473,104 B1 1/2009 Wertz
7,476,132 B2 1/2009 Xu
7,493,945 B2 2/2009 Doane et al.
7,510,017 B2 3/2009 Howell et al.
7,540,758 B2 6/2009 Ho
7,544,102 B2 6/2009 Oda
7,565,927 B2 7/2009 Gerez et al.
7,568,429 B2 8/2009 Hummel et al.
7,591,212 B2 9/2009 Myers, Jr. et al.
7,647,978 B2 1/2010 Scott
7,690,925 B2 4/2010 Goodman
7,726,396 B2 6/2010 Briquet et al.
7,735,578 B2 6/2010 Loehr et al.
7,736,261 B2 6/2010 Wittkopp et al.
7,752,971 B2 7/2010 Loehr
7,762,172 B2 7/2010 Li et al.
7,762,331 B2 7/2010 Goodman et al.
7,762,351 B2 7/2010 Vidal
7,775,279 B2 8/2010 Marya et al.
7,778,006 B2 8/2010 Stewart et al.
7,789,153 B2 9/2010 Prinz et al.
7,810,430 B2 10/2010 Chan et al.
7,815,440 B2 10/2010 Hsieh et al.
7,886,842 B2 2/2011 Howard et al.
7,901,247 B2 3/2011 Ring
7,908,970 B1 3/2011 Jakaboski et al.
7,929,270 B2 4/2011 Hummel et al.
7,934,453 B2 5/2011 Moore
7,980,874 B2 7/2011 Finke et al.
8,028,624 B2 10/2011 Mattson
8,061,425 B2 11/2011 Hales et al.
8,066,083 B2 11/2011 Hales et al.
8,069,789 B2 12/2011 Hummel et al.
8,074,713 B2 12/2011 Ramos et al.
8,074,737 B2 12/2011 Hill et al.
8,079,296 B2 12/2011 Barton et al.
8,091,477 B2 1/2012 Brooks et al.
8,127,846 B2 3/2012 Hill et al.
8,136,439 B2 3/2012 Bell
8,141,434 B2 3/2012 Kippersund et al.
8,151,882 B2 4/2012 Grigar et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,230,788 B2 7/2012 Brooks et al.

(56) References Cited

U.S. PATENT DOCUMENTS 8,256,337 B2 9/2012 Hill et al.
8,336,437 B2 12/2012 Barlow et al.
8,336,635 B2 12/2012 Greenlee et al.
8,387,533 B2 3/2013 Runkel
8,388,374 B2 3/2013 Grek et al.
8,395,878 B2 3/2013 Stewart et al.
8,413,727 B2 4/2013 Holmes
8,439,114 B2 5/2013 Parrott et al.
8,451,137 B2 5/2013 Bonavides et al.
8,468,944 B2 6/2013 Givens et al.
8,596,378 B2 12/2013 Mason et al.
8,661,978 B2 3/2014 Backhus et al.
8,678,666 B2 3/2014 Scadden et al.
8,684,083 B2 4/2014 Torres et al.
8,695,506 B2 4/2014 Lanclos
8,807,003 B2 8/2014 Le et al.
8,807,206 B2 8/2014 Walker
8,833,441 B2 9/2014 Fielder et al.
8,863,665 B2 10/2014 DeVries et al.
8,869,887 B2 10/2014 Deere et al.
8,875,787 B2 11/2014 Tassaroli
8,875,796 B2 11/2014 Hales et al.
8,881,816 B2 11/2014 Glenn et al.
8,884,778 B2 11/2014 Lerche et al.
8,931,569 B2 1/2015 Fagley et al.
8,943,943 B2 2/2015 Tassaroli
8,960,093 B2 2/2015 Preiss et al.
8,960,288 B2 2/2015 Sampson
9,065,201 B2 6/2015 Borgfeld et al.
9,080,433 B2 7/2015 Lanclos et al.
9,145,763 B1 9/2015 Sites, Jr.
9,145,764 B2 9/2015 Burton et al.
9,181,790 B2 11/2015 Mace et al.
9,194,219 B1 11/2015 Hardesty et al.
9,206,675 B2 12/2015 Hales et al.
9,284,819 B2 3/2016 Tolman et al.
9,284,824 B2 3/2016 Fadul et al.
9,297,242 B2 3/2016 Zhang et al.
9,317,038 B2 4/2016 Ozick et al.
9,347,755 B2 5/2016 Backhus et al.
9,359,863 B2 6/2016 Streich et al.
9,383,237 B2 7/2016 Wiklund et al.
9,428,979 B2 8/2016 Bell et al.
9,466,916 B2 10/2016 Li et al.
9,476,289 B2 10/2016 Wells
9,484,646 B2 11/2016 Thomas
9,494,021 B2 11/2016 Parks et al.
9,523,265 B2 12/2016 Upchurch et al.
9,523,271 B2 12/2016 Bonavides et al.
9,581,422 B2 2/2017 Preiss et al.
9,593,548 B2 3/2017 Hill et al.
9,598,942 B2 3/2017 Wells et al.
9,605,937 B2 3/2017 Eitschberger et al.
9,617,814 B2 4/2017 Seals et al.
9,634,427 B2 4/2017 Lerner et al.
9,677,363 B2 6/2017 Schacherer et al.
9,689,223 B2 6/2017 Schacherer et al.
9,702,211 B2 7/2017 Tinnen
9,702,680 B2 7/2017 Parks et al.
9,709,373 B2 7/2017 Hikone et al.
9,784,549 B2 10/2017 Eitschberger
9,845,666 B2 12/2017 Hardesty et al.
9,903,192 B2 2/2018 Entchev et al.
10,047,591 B2 8/2018 Bell et al.
10,066,921 B2 9/2018 Eitschberger
10,077,641 B2 9/2018 Rogman et al.
10,138,713 B2 11/2018 Tolman et al.
10,151,180 B2 12/2018 Robey et al.
10,188,990 B2 1/2019 Burmeister et al.
10,190,398 B2 1/2019 Goodman et al.
10,352,144 B2 7/2019 Entchev et al.
10,400,558 B1 9/2019 Shahinpour et al.
10,429,161 B2 10/2019 Parks
10,458,213 B1 10/2019 Eitschberger et al.
10,598,002 B2 3/2020 Sites
10,683,703 B2 6/2020 Faircloth et al.
10,767,430 B2 9/2020 Covalt et al.
10,900,335 B2 1/2021 Knight et al.
10,982,513 B2 4/2021 Gupta et al.
11,053,782 B2 7/2021 Loehken et al.
11,078,762 B2 8/2021 Mauldin et al.
11,125,056 B2 9/2021 Parks
11,391,127 B1 7/2022 Hoelscher et al.
11,732,556 B2 8/2023 Eitschberger
2002/0020320 A1 2/2002 Lebaudy et al.
2002/0062991 A1 5/2002 Farrant et al.
2002/0185275 A1 12/2002 Yang et al.
2003/0000411 A1 1/2003 Cernocky et al.
2003/0001753 A1 1/2003 Cernocky et al.
2003/0098158 A1 5/2003 George et al.
2004/0141279 A1 7/2004 Amano et al.
2004/0211862 A1 10/2004 Elam
2004/0216633 A1 11/2004 Kash
2004/0216868 A1 11/2004 Owen
2005/0139352 A1 6/2005 Mauldin
2005/0167101 A1 8/2005 Sugiyama
2005/0173118 A1 8/2005 Li et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0218260 A1 10/2005 Corder et al.
2005/0229805 A1 10/2005 Myers et al.
2005/0230099 A1 10/2005 Thomson et al.
2005/0257710 A1 11/2005 Monetti et al.
2006/0075889 A1 4/2006 Walker
2007/0084336 A1 4/2007 Neves
2007/0125540 A1 6/2007 Gerez et al.
2007/0158071 A1 7/2007 Mooney, Jr. et al.
2008/0029302 A1 2/2008 Scott
2008/0047456 A1 2/2008 Li et al.
2008/0047716 A1 2/2008 McKee et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0173240 A1 7/2008 Furukawahara et al.
2008/0264639 A1 10/2008 Parrott et al.
2008/0314591 A1 12/2008 Hales et al.
2009/0050322 A1 2/2009 Hill et al.
2009/0151588 A1 6/2009 Burleson et al.
2009/0159285 A1 6/2009 Goodman
2009/0272519 A1 11/2009 Green et al.
2009/0272529 A1 11/2009 Crawford
2009/0301723 A1 12/2009 Gray
2009/0308589 A1 12/2009 Bruins et al.
2010/0000789 A1 1/2010 Barton et al.
2010/0011945 A1 1/2010 Loehr
2010/0012774 A1 1/2010 Fanucci et al.
2010/0022125 A1 1/2010 Burris et al.
2010/0024674 A1 2/2010 Peeters et al.
2010/0089643 A1 4/2010 Vidal
2010/0096131 A1 4/2010 Hill et al.
2010/0107917 A1 5/2010 Moser
2010/0163224 A1 7/2010 Strickland
2010/0206064 A1 8/2010 Estes
2010/0230104 A1 9/2010 Nölke et al.
2010/0230163 A1 9/2010 Hales et al.
2010/0252323 A1 10/2010 Goodman et al.
2010/0286800 A1 11/2010 Lerche et al.
2010/0300750 A1 12/2010 Hales et al.
2011/0024116 A1 2/2011 McCann et al.
2011/0024117 A1 2/2011 Cardenas et al.
2011/0042069 A1 2/2011 Bailey et al.
2011/0100627 A1 5/2011 Hales et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0160483 A1 6/2012 Carisella
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.

(56) References Cited

U.S. PATENT DOCUMENTS

| | | | |
|---|---|---|---|
| 2012/0247769 | A1 | 10/2012 | Schacherer et al. |
| 2012/0247771 | A1 | 10/2012 | Black et al. |
| 2012/0298361 | A1 | 11/2012 | Sampson |
| 2013/0008639 | A1 | 1/2013 | Tassaroli et al. |
| 2013/0008669 | A1 | 1/2013 | Deere et al. |
| 2013/0037255 | A1 | 2/2013 | Kash et al. |
| 2013/0043074 | A1 | 2/2013 | Tassaroli |
| 2013/0062055 | A1 | 3/2013 | Tolman et al. |
| 2013/0112396 | A1 | 5/2013 | Splittstoeßer |
| 2013/0118342 | A1 | 5/2013 | Tassaroli |
| 2013/0133889 | A1 | 5/2013 | Schacherer et al. |
| 2013/0168083 | A1 | 7/2013 | McCarter et al. |
| 2013/0199843 | A1 | 8/2013 | Ross |
| 2013/0220614 | A1 | 8/2013 | Torres et al. |
| 2013/0248174 | A1 | 9/2013 | Dale et al. |
| 2013/0256464 | A1 | 10/2013 | Belik et al. |
| 2014/0000877 | A1 | 1/2014 | Robertson et al. |
| 2014/0033939 | A1 | 2/2014 | Priess et al. |
| 2014/0053750 | A1 | 2/2014 | Lownds et al. |
| 2014/0127941 | A1 | 5/2014 | Lu |
| 2014/0131035 | A1 | 5/2014 | Entchev et al. |
| 2014/0144702 | A1 | 5/2014 | Walker |
| 2014/0148044 | A1 | 5/2014 | Balcer et al. |
| 2014/0251612 | A1 | 9/2014 | Powers |
| 2015/0075783 | A1 | 3/2015 | Angman et al. |
| 2015/0176386 | A1 | 6/2015 | Castillo et al. |
| 2015/0226044 | A1 | 8/2015 | Ursi et al. |
| 2015/0285019 | A1 | 10/2015 | Wood et al. |
| 2015/0308208 | A1 | 10/2015 | Capps et al. |
| 2015/0330192 | A1 | 11/2015 | Rogman et al. |
| 2015/0345922 | A1 | 12/2015 | Lanclos et al. |
| 2016/0040520 | A1 | 2/2016 | Tolman et al. |
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0168961 | A1 | 6/2016 | Parks et al. |
| 2016/0178333 | A1 | 6/2016 | Biggs et al. |
| 2016/0208587 | A1 | 7/2016 | Hardesty et al. |
| 2016/0273902 | A1 | 9/2016 | Eitschberger |
| 2016/0333675 | A1 | 11/2016 | Wells et al. |
| 2016/0365667 | A1 | 12/2016 | Mueller et al. |
| 2017/0030693 | A1 | 2/2017 | Preiss et al. |
| 2017/0051586 | A1 | 2/2017 | Wells et al. |
| 2017/0052011 | A1 | 2/2017 | Parks et al. |
| 2017/0052586 | A1 | 2/2017 | Nejedlo |
| 2017/0145798 | A1 | 5/2017 | Robey et al. |
| 2017/0175498 | A1 | 6/2017 | Segura |
| 2017/0211363 | A1 | 7/2017 | Bradley et al. |
| 2017/0241244 | A1 | 8/2017 | Barker et al. |
| 2017/0268860 | A1 | 9/2017 | Eitschberger |
| 2017/0314372 | A1 | 11/2017 | Tolman et al. |
| 2018/0030334 | A1 | 2/2018 | Collier et al. |
| 2018/0135398 | A1 | 5/2018 | Entchev et al. |
| 2018/0202789 | A1 | 7/2018 | Parks et al. |
| 2018/0209251 | A1 | 7/2018 | Robey et al. |
| 2018/0274342 | A1 | 9/2018 | Sites |
| 2018/0299239 | A1 | 10/2018 | Eitschberger et al. |
| 2018/0318770 | A1 | 11/2018 | Eitschberger et al. |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0195054 | A1 | 6/2019 | Bradley et al. |
| 2019/0211655 | A1 | 7/2019 | Bradley et al. |
| 2019/0284889 | A1 | 9/2019 | LaGrange et al. |
| 2019/0292887 | A1 | 9/2019 | Austin et al. |
| 2019/0316449 | A1 | 10/2019 | Schultz et al. |
| 2020/0063553 | A1 | 2/2020 | Zemla et al. |
| 2020/0088011 | A1 | 3/2020 | Eitschberger et al. |
| 2020/0182025 | A1 | 6/2020 | Brady |
| 2020/0362652 | A1 | 11/2020 | Eitschberger et al. |
| 2020/0362654 | A1 | 11/2020 | Eitschberger et al. |
| 2020/0378731 | A1 | 12/2020 | Mcnelis |
| 2020/0399995 | A1 | 12/2020 | Preiss et al. |
| 2021/0238966 | A1 | 8/2021 | Preiss et al. |
| 2023/0045109 | A1 | 2/2023 | Goyeneche |
| 2023/0212927 | A1 | 7/2023 | Cook et al. |

FOREIGN PATENT DOCUMENTS

| | | | |
|---|---|---|---|
| CA | 2003166 | A1 | 5/1991 |
| CA | 2821506 | A1 | 1/2015 |
| CA | 2824838 | A1 | 2/2015 |
| CA | 2888787 | A1 | 10/2015 |
| CA | 2980935 | A1 | 10/2016 |
| CA | 3101558 | A1 | 12/2019 |
| CN | 85107897 | A | 9/1986 |
| CN | 2648065 | | 10/2004 |
| CN | 2661919 | | 12/2004 |
| CN | 2821154 | | 9/2006 |
| CN | 101397890 | A | 4/2009 |
| CN | 101691837 | B | 4/2010 |
| CN | 101178005 | B | 10/2010 |
| CN | 201620848 | U | 11/2010 |
| CN | 201764910 | U | 3/2011 |
| CN | 202165062 | U | 3/2012 |
| CN | 102878877 | A | 1/2013 |
| CN | 202810806 | U | 3/2013 |
| CN | 103993861 | A | 8/2014 |
| CN | 104278976 | A | 1/2015 |
| CN | 104989335 | A | 10/2015 |
| CN | 205805521 | U | 12/2016 |
| CN | 104314529 | B | 1/2017 |
| CN | 205895214 | U | 1/2017 |
| CN | 209195375 | U | 8/2019 |
| CN | 213297926 | U | 5/2021 |
| DE | 102007007498 | | 10/2015 |
| EP | 0088516 | A1 | 9/1983 |
| EP | 132330 | B1 | 9/1988 |
| EP | 0216527 | B1 | 11/1990 |
| EP | 0416915 | A2 | 3/1991 |
| EP | 0180520 | B1 | 5/1991 |
| EP | 679859 | A2 | 11/1995 |
| EP | 0482969 | B1 | 8/1996 |
| EP | 694157 | B1 | 8/2001 |
| EP | 2702349 | B1 | 11/2015 |
| EP | 2310616 | B1 | 10/2017 |
| EP | 3277913 | A1 | 2/2018 |
| EP | 3239648 | B1 | 9/2018 |
| EP | 3478928 | B1 | 6/2021 |
| GB | 2383236 | B | 1/2004 |
| JP | 2003329399 | A | 11/2003 |
| RU | 2295694 | C2 | 3/2007 |
| RU | 78521 | U1 | 11/2008 |
| RU | 93521 | U1 | 4/2010 |
| RU | 100552 | U1 | 12/2010 |
| RU | 2434122 | C2 | 11/2011 |
| RU | 2542024 | C1 | 2/2015 |
| RU | 2561828 | C2 | 9/2015 |
| RU | 2579307 | C1 | 4/2016 |
| RU | 2633904 | C1 | 10/2017 |
| WO | 8802056 | A1 | 3/1988 |
| WO | 1988002056 | A1 | 3/1988 |
| WO | 1994009246 | A1 | 4/1994 |
| WO | 9905390 | A1 | 2/1999 |
| WO | 1999005390 | A1 | 2/1999 |
| WO | 0133029 | A3 | 5/2001 |
| WO | 0159401 | A1 | 8/2001 |
| WO | 2001059401 | A1 | 8/2001 |
| WO | 2001096807 | A2 | 12/2001 |
| WO | 2008098052 | A3 | 10/2008 |
| WO | 2009091422 | A2 | 7/2009 |
| WO | 2009091422 | A3 | 3/2010 |
| WO | 2010104634 | A2 | 9/2010 |
| WO | 2012006357 | A2 | 1/2012 |
| WO | 2012135101 | A2 | 10/2012 |
| WO | 2012106640 | A3 | 11/2012 |
| WO | 2012149584 | A1 | 11/2012 |
| WO | 2014046670 | A1 | 3/2014 |
| WO | 2014089194 | A1 | 6/2014 |
| WO | 2015006869 | A1 | 1/2015 |
| WO | 2015028204 | A2 | 3/2015 |
| WO | 2015134719 | A1 | 9/2015 |

(56) References Cited

FOREIGN PATENT DOCUMENTS

| | | | |
|---|---|---|---|
| WO | 2016100269 | A1 | 6/2016 |
| WO | 2017062444 | A1 | 4/2017 |
| WO | 2018009223 | A1 | 1/2018 |
| WO | 2018057949 | A1 | 3/2018 |
| WO | 2019071027 | A1 | 4/2019 |
| WO | 2019148009 | A2 | 8/2019 |
| WO | 2020154061 | A1 | 7/2020 |
| WO | 2022135749 | A1 | 6/2022 |

OTHER PUBLICATIONS

Dynaenergetics Europe GMBH; Exposed Gun Subs & Accessories; dated May 23, 2017; https://www.dynaenergetics.com/products/hardware-and-tcp/perforating-gun-systems/exposed-gun-subs-accessories.
Dynaenergetics Europe GMBH; Patent Owner's Preliminary Response for PGR No. 2021-00089; dated Sep. 16, 2021; 106 pages.
Dynaenergetics Europe GMBH; Patent Owner's Preliminary Response for PGR2020-00072; dated Oct. 23, 2020; 108 pages.
Dynaenergetics Europe GMBH; Patent Owner's Preliminary Response for PGR2020-00080; dated Nov. 18, 2020; 119 pages.
Dynaenergetics Europe Gmbh; Patent Owner's Preliminary Response for PGR2021-00078; dated Aug. 19, 2021; 114 pages.
Dynaenergetics Europe GMBH; Plaintiff's Preliminary Infringement Contentions for Civil Action No. 6:21-cv-01110; dated Jul. 6, 2021; 6 pages.
Dynaenergetics Europe GMBH; Principal and Response Brief of Cross-Appellant for United States Court of Appeals case No. 2020-2163, -2191; dated Jan. 11, 2021; 95 pages.
Dynaenergetics Europe GMBH; Reply Under 37 C.F.R. §1.111 Amendment Under 37 C.F.R. §1.121 for U.S. Appl. No. 16/585,790; dated Feb. 20, 2020; 18 pages.
Dynaenergetics Europe, GMBH; DynaEnergetics' Preliminary Claim Construction and Extrinsic Evidence for Civil Action No. 4:21-cv-00280; dated Aug. 4, 2021; 10 pages.
Dynaenergetics Europe, GMBH; Patent Owner's Preliminary Response for PGR No. 2021-00097; dated Oct. 29, 2021; 110 pages.
Dynaenergetics Europe; Defendants' Preliminary Infringement Contentions for Civil Action No. 3:20-CV-00376; dated Mar. 25, 2021; 22 pages.
Dynaenergetics Europe; DynaEnergetics Celebrates Grand Opening of DynaStage Manufacturing and Assembly Facilities in Blum, Texas; dated Nov. 16, 2018; 3 pages.
Dynaenergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
Dynaenergetics Europe; Exhibit B Invalidity Claim Chart for Civil Action No. 4:19-cv-01611; dated May 2, 2019; 52 pages.
Dynaenergetics Europe; Petition to Correct Inventorship in Patent under 37 C.F.R § 1.324; dated Oct. 13, 2020; 21 pages.
Dynaenergetics Europe; Plaintiffs' Local Patent Rule 3-1 Infringement Contentions for Civil Action No. 4:19-cv-01611; dated May 25, 2018; 10 Pages.
Dynaenergetics Europe; Plaintiffs' Pending Motion For Reconsideration for Civil Action No. 4:17-cv-03784; dated Jan. 21, 2021; 4 pages.
Dynaenergetics Europe; Plaintiffs' Preliminary Claim Constructions and Identification of Extrinsic Evidence Civil Action No. 4:17-cv-03784; dated Aug. 3, 2018; 9 pages.
Dynaenergetics Europe; Plaintiffs' Preliminary Infringement Contentions, Civil Action No. 6:20-cv-00069-ADA; dated Apr. 22, 2020; 32 pages.
Dynaenergetics Europe; Plaintiff's Preliminary Infringment Contentions Civil Action No. 3:21-cv-00192-M; dated Jun. 18, 2021; 15 pages.
Dynaenergetics Europe; Plaintiffs' Reply in Support of Motion to Dismiss and Strike for Civil Action No. 6:20-cv-00069-ADA; dated Apr. 29, 2020; 15 pages.
Dynaenergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
Dynaenergetics Europe; Plaintiffs' Response to Defendants' Answer to Second Amended Complaint Civil Action No. 6:20-cv-00069-ADA; dated May 26, 2020; 18 pages.
DynaEnergetics exhibition and product briefing; Exhibit 2006 of PGR No. 2020-00072; dated 2013; 15 pages.
Dynaenergetics Gmbh & Co. Kg, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, No Debris Gun System (NDG), Hamburg, Germany, Feb. 6, 2008, 26 pgs.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Dynaenergetics; DynaStage Solution—Factory Assembled Performance-Assured Perforating Systems; 6 pages.
DynaStage Gun System; Exhibit 2009 of PGR No. 2020-00080; dated May 2014; 2 pages.
Entchev et al., Autonomous Perforating System for Multizone Completions, SPE International, 2011, 7 pgs., https://www.onepetro.org/conference-paper/SPE-147296-MS.
EP Patent Office—International Searching Authority, PCT Search Report and Written Opinion for PCT Application No. PCT/EP2014/065752, mailed May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; issued Dec. 13, 2016; 2 pages.
European Patent Office; Office Action for EP App. No. 15721178.0; issued Sep. 6, 2018; 5 pages.
Fayard, Alfredo; Declaration of Alfredo Fayard; dated Oct. 18, 2021; 13 pages.
Federal Institute of Industrial Property; Decision of Granting for RU Appl. No. 2016104882/03(007851); May 17, 2018; 15 pages (English translation 4 pages).
Federal Institute of Industrial Property; Decision on Granting a Patent for Invention Russian App. No 2016139136/03(062394); issued Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
G&H Diversified Manufacturing LP; Petition for Post Grant Review PGR No. 2021-00078; dated May 10, 2021; 122 pages.
G&H Diversified Manufacturing, LP and Dynaenergetics Europe GMBH; Joint Claim Construction Statement for Civil Action No. 3:20-cv-00376; dated Jul. 8, 2021; 14 pages.

(56) References Cited

OTHER PUBLICATIONS

G&H Diversified Manufacturing, LP; Defendant G&H Diversified Manufacturing, LP's Answer to Counter—Claim Plaintiffs' Counter-Claims for Civil Action No. 3:20-cv-00376; dated Apr. 19, 2021; 13 pages.
Norwegian Industrial Patent Office; Approval for Grant of Norwegian Application No. 20180507 dated Oct. 18, 2023; 2 pages.
United States Patent and Trademark Office; Ex Parte Quayle Action issued in U.S. Appl. No. 17/223,899 dated Aug. 29, 2023; 6 pages.
Norwegian Industrial Property Office; Office Action issued in Norwegian Application No. 20210799 dated Jan. 17, 2024, 3 pages.
Norwegian Industrial Property Office; Office Action issued in Norwegian Application No. 20171759 dated Jan. 14, 2020, 4 pages.
Norwegian Industrial Property Office; Search Report issued in Norwegian Application No. 20171759 dated Jan. 14, 2020, 2 pages.
Norwegian Industrial Property Office; Office Action issued in Norwegian Application No. 20180507 dated Jan. 23, 2023, 3 pages.
Norwegian Industrial Property Office; Search Report issued in Norwegian Application No. 20180507 dated Jan. 23, 2023, 2 pages.
United States Patent and Trademark Office; Non-Final Office Action issued in U.S. Appl. No. 17/951,606 dated Jan. 17, 2023; 11 pages.
United States Patent and Trademark Office; Notice of Allowance issued in U.S. Appl. No. 16/540,484 dated Jan. 5, 2023; 7 pages.
United States Patent and Trademark Office; Requirement for Restriction/Election issued in U.S. Appl. No. 17/223,899 dated Mar. 17, 2023; 5 pages.
United States Patent and Trial Appeal Board; Final Written Decision on PGR2021-00097; issued Jan. 3, 2023; 112 pages.
United States Patent and Trademark Office; Requirement for Restriction/Election issued in U.S. Appl. No. 17/875,585 dated Jun. 15, 2023; 5 pages.
United States Patent and Trademark Office; Non-Final Office Action issued in U.S. Appl. No. 17/875,585 dated Nov. 21, 2023; 8 pages.
United States Patent and Trademark Office; Notice of Allowance issued in U.S. Appl. No. 17/875,585 dated May 2, 2024; 8 pages.
United States Patent and Trademark Office; Final Office Action issued in U.S. Appl. No. 18/069,518 dated Jul. 23, 2024; 7 pages.
United States Patent and Trademark Office; Non-Final Office Action issued in U.S. Appl. No. 18/327,451 dated Aug. 1, 2024; 15 pages.
G&H Diversified Manufacturing, LP; Defendant G&H Diversified Manufacturing, LP's Opening Claim Construction Brief; dated Oct. 18, 2021; 25 pages.
G&H Diversified Manufacturing, Lp; Defendants' Preliminary Invalidity Contentions for Civil Action No. 3:20- cv-00376; dated May 6, 2021; 20 pages.
G&H Diversified Manufacturing, LP; Plaintiff and Counterclaim Defendant G&H Diversified Manufacturing, LP and Counterclaim Defendant Yellow Jacket Oil Tools, LLC's First Supplemental Proposed Constructions; dated Jun. 24, 2021; 7 pages.
G&H Diversified Manufacturing, LP; Plaintiff and Counterclaim Defendant G&H Diversified Manufacturing, LP and Counterclaim Defendant Yellow Jacket Oil Tools, LLC's Proposed Constructions; dated Jun. 10, 2021; 7 pages.
G&H Diversified Manufacturing, LP; Redated Petition for Post Grant Review for PGR2021-00078; dated May 10, 2021; 20 pages.
G&H Diversified Manufacturing, LP; Reply to Preliminary Response for PGR No. PGR2021-00078; dated Sep. 14, 2021; 18 pages.
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
GB Intellectual Property Office, Examination Report for GB App. No. GB1600085.3, mailed Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; Apr. 13, 2018; 3 pages.
GB Intellectual Property Office; Notification of Grant for GB Appl. No. 1717516.7; Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; mailed Dec. 21, 2017; 5 pages.
German Patent Office, Office Action for German Patent Application No. 10 2013 109 227.6, which is in the same family as PCT Application No. PCT/EP2014/065752, see p. 5 for references cited, May 22, 2014, 8 pgs.
Gilliat et al.; New Select-Fire System: Improved Reliability and Safety in Select Fire Operations; 2012; 16 pgs.
Global Wireline Market; Exhibit 2010 of PGR 2020-00072; dated Oct. 15, 2019; 143 pages.
*GR Energy Operating GP LLC, GR Energy Services Management, LP and GR Energy Services, LLC*; Exhibit A U.S. Pat. No. 10,844,697 vs *Castel*; dated Aug. 30, 2021; 88 pages.
*GR Energy Operating GP LLC, GR Energy Services Management, LP and Gr Energy Services, LLC*; Exhibit B U.S. Pat. No. 10,844,697 vs *Goodman*; dated Aug. 30, 2021; 36 pages.
*GR Energy Operating GP LLC, GR Energy Services Management, LP and Gr Energy Services, LLC*; Exhibit C U.S. Pat. No. 10,844,697 vs *Hromas*; dated Aug. 30, 2021; 27 pages.
*GR Energy Operating GP LLC, GR Energy Services Management, LP and Gr Energy Services, LLC*; Exhibit D U.S. Pat. No. 10,844,697 vs *Boop* 768; dated Aug. 30, 2021; 35 pages.
*GR Energy Operating GP LLC, GR Energy Services Management, LP and Gr Energy Services, LLC*; Exhibit E U.S. Pat. No. 10,844,697 vs *Boop* 792; dated Aug. 30, 2021; 52 pages.
*GR Energy Operating GP LLC, GR Energy Services Management, LP and GR Energy Services, LLC*; Exhibit F U.S. Pat. No. 10,844,697 vs *Boop* 378; dated Aug. 30, 2021; 34 pages.
*GR Energy Operating GP LLC, GR Energy Services Management, LP and GR Energy Services, LLC*; Exhibit G U.S. Pat. No. 10,844,697 vs *Bickford*; dated Aug. 30, 2021; 7 pages.
*GR Energy Operating GP LLC, GR Energy Services Management, LP and GR Energy Services, LLC*; Exhibit H U.S. Pat. No. 10,844,697 vs *Black*; dated Aug. 30, 2021; 33 pages.
*GR Energy Operating GP LLC, GR Energy Services Management, LP and GR Energy Services, LLC*; Exhibit I U.S. Pat. No. 10,844,697 vs *Rogman*; dated Aug. 30, 2021; 59 pages.
*GR Energy Operating GP LLC, GR Energy Services Management, LP and GR Energy Services, LLC*; Exhibit J U.S. Pat. No. 10,844,697 vs *Burton*; dated Aug. 30, 2021; 57 pages.
*GR Energy Operating GP LLC, GR Energy Services Management, LP and GR Energy Services, LLC*; Exhibit K U.S. Pat. No. 10,844,697 vs *Borgfeld*; dated Aug. 30, 2021; 36 pages.
*GR Energy Operating GP LLC, GR Energy Services Management, LP and GR Energy Services, LLC*; Exhibit L U.S. Pat. No. 10,844,697 vs *Boop* '383; dated Aug. 30, 2021; 24 pages.
*GR Energy Operating GP LLC, GR Energy Services Management, LP and GR Energy Services, LLC*; Exhibit M U.S. Pat. No. 10,844,697 vs *Boop* '992; dated Aug. 30, 2021; 14 pages.
*GR Energy Operating GP LLC, GR Energy Services Management, LP and GR Energy Services, LLC*; Exhibit N U.S. Pat. No. 10,844,697 vs *Deere*; dated Aug. 30, 2021; 14 pages.
*GR Energy Operating GP LLC, GR Energy Services Management, LP and GR Energy Services, LLC*; Exhibit O U.S. Pat. No. 10,844,697 vs *Harrigan Provisional*; dated Aug. 30, 2021; 26 pages.
*GR Energy Operating GP LLC, GR Energy Services Management, LP and GR Energy Services, LLC*; Exhibit P U.S. Pat. No. 10,844,697 vs *Burke* '251; dated Aug. 30, 2021; 7 pages.
*GR Energy Operating GP LLC, GR Energy Services Management, LP and GR Energy Services, LLC*; Exhibit Q U.S. Pat. No. 10,844,697 vs *Runkel*; dated Aug. 30, 2021; 7 pages.
*GR Energy Operating GP LLC, GR Energy Services Management, LP and GR Energy Services, LLC*; Exhibit R U.S. Pat. No. 10,844,697 vs *Tassaroli*; dated Aug. 30, 2021; 10 pages.
*GR Energy Operating GP LLC, GR Energy Services Management, LP and GR Energy Services, LLC*; Exhibit S U.S. Pat. No. 10,844,697 vs *Harrigan* '048; dated Aug. 30, 2021; 7 pages.
*GR Energy Operating GP LLC, GR Energy Services Management, LP and GR Energy Services, LLC*; Exhibit T U.S. Pat. No. 10,844,697 vs *Select-Fire System*; dated Aug. 30, 2021; 36 pages.

(56) References Cited

OTHER PUBLICATIONS

*GR Energy Operating GP LLC, GR Energy Services Management, LP and GR Energy Services, LLC*; Exhibit U U.S. Pat. No. 10,844,697 vs *New Select-Fire System*; dated Aug. 30, 2021; 37 pages.
*GR Energy Operating GP LLC, GR Energy Services Management, LP and GR Energy Services, LLC*; Exhibit V U.S. Pat. No. 10,844,697 vs *EWAPS*; dated Aug. 30, 2021; 17 pages.
*GR Energy Operating GP LLC, GR Energy Services Management, LP and GR Energy Services, LLC*; Exhibit W U.S. Pat. No. 10,844,697 vs *SafeJet System*; dated Aug. 30, 2021; 17 pages.
GR Energy Operating GP LLC, GR Energy Services Management, LP and GR Energy Services, LLC; GR Energy's Preliminary Invalidity Contentions for Civil Action No. 6:21-cv-00085-ADA; dated Aug. 30, 2021; 18 pages.
GR Energy Services Operating GP LLC, GR Energy Services Management, LP and GR Energy Services, LLC; GR Energy's Opening Claim Construction Brief; dated Oct. 18, 2021; 23 pages.
Harrison Jet Guns; Image of "xtra penetrator".
Heard, Preston; Declaration for PGR2021-00078; dated Aug. 19, 2021; 5 pages.
Horizontal Wireline Services, LLC and Allied Wireline Services, LLC; Defendants' Opening Claim Construction Brief; dated Oct. 18, 2021; 27 pages.
Horizontal Wireline Services, LLC and Allied Wireline Services, LLC; Defendants' Preliminary Invalidity Contentions for Civil Action No. 6:21-cv-00349-ADA; dated Aug. 30, 2021; 22 pages.
Horizontal Wireline Services, LLC and Allied Wireline Services, LLC; Exhibit A1 U.S. Pat. No. 5,155,293 to Barton vs. Asserted Claims of U.S. Pat. No. 10,844,697; dated Aug. 30, 2021; 21 pages.
Horizontal Wireline Services, LLC and Allied Wireline Services, LLC; Exhibit A23 Amit Govil, "Selective Perforation: A Game Changer in Perforating Technology—Case Study," 2012 European and West African Perforating Symposium vs. Asserted Claims of U.S. Pat. No. 10,844,697; dated Aug. 30, 2021; 17 pages.
Horizontal Wireline Services, LLC and Allied Wireline Services, LLC; Exhibit A5 U.S. Pat. No. 9,175,553 to Mcann, et al. vs. Asserted Claims of U.S. Pat. No. 10,844,697; dated Aug. 30, 2021; 26 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
United States Patent and Trademark Office; U.S. Appl. No. 62/736,298; dated Sep. 25, 2018; 120 pages.
United States Patent and Trial Appeal Board; Final Written Decision on IPR2018-00600; issued Aug. 20, 2019; 31 pages.
United States Patent Trial and Appeal Board; Decision Denying Institution of Post-Grant Review; PGR No. 2020-00072; dated Jan. 19, 2021; 38 pages.
United States Patent Trial and Appeal Board; Institution Decision for PGR 2020-00080; dated Feb. 12, 2021; 15 pages.
United States Patent Trial and Appeal Board; Record of Oral Hearing held Feb. 18, 2020 for IPR dated 2018-00600; dated Feb. 18, 2020; 27 pages.
Vigor Petroleum; Perforating Gun Accessories Product Description; https://www.vigordrilling.com/completion-tools/perforating-gun-accessories.html; 2021; 1 page.
Wetechnologies; Downhole Connectors, High Pressure HP / HT & Medium Pressure MP /MT; dated Apr. 3, 2016; http://wetechnologies.com/products/hp-ht-downhole/; 3 pages.
Williams, John; Declaration of Dr. John Williams; dated Oct. 18, 2021; 9 pages.
WIPO, International Search Report for International Application No. PCT/CA2014/050673, mailed Oct. 9, 2014, 3 pgs.
WIPO, Written Opinion of International Searching Authority for PCT Application No. PCT/CA2014/050673, mailed Oct. 9, 2014, 4 pgs.
Wooley, Gary R.; Declaration in Support of Petition for Post Grant Review of U.S. Pat. No. 10,844,697 for PGR2021-00097; dated Jul. 17, 2021; 90 pages.
Wooley, Gary R; Declaration of Gary R. Wooley, PH.D. Regarding Claim Construction for Civil Action No. 6:21-cv-00225-ADA; dated Oct. 6, 2021; 67 pages.
Wooley, Gary; Declaration of Gary E. Wooley for Civil Action Nos. 6:20-cv-01110-ADA and 6:20-CV-01201-ADA; dated Oct. 18, 2021; 12 pages.
Wooley, Gary; Declaration of Gary R. Wooley for Civil Action No. 3:20-cv-00376; dated Jul. 8, 2021; 11 pages.
Wooley, Gary; Declaration of Gary R. Wooley for Civil Action No. 3:21-cv-00192-M; dated Aug. 17, 2021; 18 pages.
Wooley, Gary; Rebuttal Declaration of Gary R. Wooley, Ph.D. Regarding Claim Construction; dated Nov. 10, 2021; 34 pages.
Wooley, Gary; Transcript of Gary Wooley for Civil Action No. 3:21-cv-00192-M; dated Sep. 2, 2021; 26 pages.
Yellow Jacket Oil Tools, LLC; Defendant Yellow Jacket Oil Tools, LLC's Answer to Plaintiffs' First Amended Complaint for Civil Action No. 6:20-cv-01110; dated Aug. 10, 2021; 13 pages.
Yellowjacket Oil Tools, LLC and G&H Diversified Manufacturing, LP; Defendants' Preliminaray Invalidity Contentions for Civil Action No. 6:20-cv-01110-ADA; dated May 6, 2021; 20 pages.
Yellowjacket Oil Tools, LLC and G&H Diversified Manufacturing, LP; Defendants' Preliminary Invalidity Contentions for Civil Action No. 6:20-cv-01110-ADA; dated Aug. 30, 2021; 21 pages.
Yellowjacket Oil Tools, LLC and G&H Diversified Manufacturing, LP; Exhibit A-9 Selective perforation: A Game Changer in Peforating Technology—Case Study; dated Aug. 30, 2021; 13 pages.
Yellowjacket, G&H and Nextier, Invalidity Chart in Litigation re Schlumberger SafeJet, dated as early as Aug. 30, 2021, 13 pgs.
Yellowjacket, G&H and Nextier, Invalidity Chart in Litigation re U.S. Pat. No. 10,844,697, "New Select-Fire System" Publication and Select-Fire System by BakerHughes vs. Asserted Claims, dated as early as Aug. 30, 2021, 33 pgs.
Yellowjacket, G&H and Nextier, Invalidity Chart in Litigation re U.S. Pat. No. 10,844,697, New Select-Fire System vs. Asserted Claims, dated as early as Aug. 30, 2021, 33 pgs.
Yellowjacket, G&H and Nextier, Invalidity Chart in Litigation re U.S. Pat. No. 10,844,697, U.S. Patent Publication No. 2013/0126237 A1 to Burton vs Asserted Claims, dated as early as Aug. 30, 2021, 3 pgs.
Yellowjacket, G&H and Nextier, Invalidity Chart in Litigation re U.S. Pat. No. 10,844,697, U.S. Patent Publication No. 2016 0084048 A1 to Harrigan et al. vs. Asserted Claims, dated as early as Aug. 30, 2021, 4 pgs.
Yellowjacket, G&H and Nextier, Invalidity Chart in Litigation re U.S. Pat. No. 10,844,697, U.S. Appl. No. 61/733,129 vs. Asserted Claims, dated as early as Aug. 30, 2021, 55 pgs.
Yellowjacket, G&H and Nextier, Invalidity Chart in Litigation re U.S. Pat. No. 10,844,697, U.S. Appl. No. 61/819,196 to Harrigan et al. vs. Asserted Claims, dated as early as Aug. 30, 2021, 26 pgs.
Yellowjacket, G&H and Nextier, Invalidity Chart in Litigation re U.S. Pat. No. 10,844,697, US Pub. No. 2012/0247771 vs. Asserted Claims, dated as early as Aug. 30, 2021, 30 pgs.
Yellowjacket, G&H and Nextier, Invalidity Chart in Litigation re U.S. Pat. No. 10,844,697, U.S. Pat. No. 10,077,641 to Rogman vs. Asserted Claims, dated as early as Aug. 30, 2021, 36 pgs.
Yellowjacket, G&H and Nextier, Invalidity Chart in Litigation re U.S. Pat. No. 10,844,697, U.S. Pat. No. 3,173,229 to Gene T. Boop vs. Asserted Claims, dated as early as Aug. 30, 2021, 12 pgs.
Yellowjacket, G&H and Nextier, Invalidity Chart in Litigation re U.S. Pat. No. 10,844,697, U.S. Pat. No. 4,457,383 to Gene T. Boop vs. Asserted Claims, dated as early as Aug. 30, 2021, 22 pgs.
Yellowjacket, G&H and Nextier, Invalidity Chart in Litigation re U.S. Pat. No. 10,844,697, U.S. Pat. No. 6,506,083 vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 6,582,251 to Burke et al. vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 7,226,303 to Shaikh vs. Asserted Claims, dated as early as Aug. 30, 2021, 4 pgs.
Yellowjacket, G&H and Nextier, Invalidity Chart in Litigation re U.S. Pat. No. 10,844,697, U.S. Pat. No. 7,762,331 to Goodman vs. Asserted Claims, dated as early as Aug. 30, 2021, 4 pgs.

(56) References Cited

OTHER PUBLICATIONS

Yellowjacket, G&H and Nextier, Invalidity Chart in Litigation re U.S. Pat. No. 10,844,697, U.S. Pat. No. 8,387,533 to Runkel vs. Asserted Claims, dated as early as Aug. 30, 2021, 5 pgs.
Yellowjacket, G&H and Nextier, Invalidity Chart in Litigation re U.S. Pat. No. 10,844,697, U.S. Pat. No. 8,943,943 to Carlos Jose Tassaroli vs. Asserted Patents, dated as early as Aug. 30, 2021, 7 pgs.
Yellowjacket, G&H and Nextier, Invalidity Chart in Litigation re U.S. Pat. No. 10,844,697, U.S. Pat. No. 9,065,201 to Borgfeld et al.vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 9,874,083 to Logan vs. Asserted Claims, dated as early as Aug. 30, 2021, 18 pgs.
G&H Diversified Manufacturing, LP; Petitioner's Oral Argument Presentation for PGR No. PGR2021-00078; dated Jul. 26, 2022; 65 pages.
International Searching Authority; International Preliminary Report on Patentability of the International Searching Authority for PCT/EP2020/085624; mailed on Jun. 23, 2022; 6 pages.
SWM International, LLC and Nextier Completion Solutions Inc; Petitioner's Reply To Patentowner's Response to Petition for Case No. PGR2021-00097; dated Jul. 29, 2022; 36 pages.
INPI Argentina; Office Action for Application No. 20190101834; dated Aug. 22, 2022; 3 pages.
Norwegian Industrial Property Office; Office Action for No. U.S. Appl. No. 20/180,507; dated Sep. 29, 2022; 2 pages.
United States Patent and Trademark Office; Notice of Allowance for U.S. Appl. No. 16/809,729; dated Sep. 21, 2022; 7 pages.
United States Patent and Trademark Office; Notice of Allowance for U.S. Appl. No. 17/007,574; dated Sep. 26, 2022; 8 pages.
United States Patent and Trademark Office; Notice of Allowance for U.S. Appl. No. 17/352,728; dated Sep. 21, 2022; 8 pages.
United States District Court for the Southern District of Texas; Memorandum Opinion and Order for Civil Action No. H-20-2123; dated Sep. 19, 2022; 115 pages.
United States Patent and Trial Appeal Board; Final Written Decision on PGR2021-00078; issued Oct. 28, 2022; 139 pages.
Parrott, Robert; Declaration for IPR2021-00082; dated Oct. 20, 2020; 110 pages.
Parrott, Robert; Declaration for PGR No. 2021-00078; dated May 10, 2021; 182 pages.
Patent Trial and Appeal Board; Decision Granting Patent Owner's Request for Rehearing and Motion to Amend for IPR2018-00600; dated Jul. 6, 2020; 27 pages.
Patent Trial and Appeals Board; Decision Granting Institution of Post Grant Review, PGR No. PGR2021-00097; dated Jan. 6, 2022; 92 pages.
PCT Search Report and Written Opinion, mailed May 4, 2015: See Search Report and Written opinion for PCT Application No. PCT/EP2014/065752, 12 pgs.
Perfx Wireline Services, LLC; PerfX Wireline Services, LLC's Preliminary Invalidity Contentions for Civil Action No. 1:20-CV-03665; dated Jul. 2, 2021; 4 pages.
Perfx Wireline Services, LLC; Defendant PerfX Wireline Services, LLC's Opening Claim Construction Brief; dated Oct. 18, 2021; 23 pages.
Perfx Wireline Services, LLC; Invalidity Chart for U.S. Pat. No. 10,844,697 in view of the Dynawell Gun System Exhibit A; dated Jul. 2, 2021; 42 pages.
Perfx Wireline Services, LLC; Invalidity Chart for U.S. Pat. No. 10,844,697 in view of the LRI Gun System Exhibit B; dated Jul. 2, 2021; 33 pages.
Perfx Wireline Services, LLC; Invalidity Chart for U.S. Pat. No. 10,844,697 in view of the Owen Oil Tools System Exhibit C; dated Jul. 2, 2021; 64 pages.
Perfx Wireline Services, LLC; Invalidity Chart for U.S. Pat. No. 10,844,697 in view of the Select Fire System Exhibit D; dated Jul. 2, 2021; 49 pages.
Perfx Wireline Services, LLC; Invalidity Chart for U.S. Pat. No. 10,844,697 in view of U.S. Pat. No. 10,077,641 Exhibit H; dated Jul. 2, 2021; 41 pages.
Perfx Wireline Services, LLC; Invalidity Chart for U.S. Pat. No. 10,844,697 in view of U.S. Pat. No. 4,007,796 Exhibit F; dated Jul. 2, 2021; 40 pages.
Perfx Wireline Services, LLC; Invalidity Chart for U.S. Pat. No. 10,844,697 in view of U.S. Pat. No. 5,042,594 Exhibit E; dated Jul. 2, 2021; 38 pages.
Perfx Wireline Services, LLC; Invalidity Chart for U.S. Pat. No. 10,844,697 in view of U.S. Pat. No. 9,145,764 Exhibit G; dated Jul. 2, 2021; 58 pages.
Perfx's Wireline Services, LLC; Exhibit A-1: Invalidity Chart for U.S. Pat. No. 10,844,697 in view of the Dynawell Gun System; dated Aug. 30, 2021; 30 pages.
Perfx's Wireline Services, LLC; Exhibit A-2: Invalidity Chart for U.S. Pat. No. 10,844,697 in view of the LRI Gun System; dated Aug. 30, 2021; 29 pages.
Perfx's Wireline Services, LLC; Exhibit A-3: Invalidity Chart for U.S. Pat. No. 10,844,697 in view of the Owen Oil Tools System; dated Aug. 30, 2021; 42 pages.
Perfx's Wireline Services, LLC; Exhibit A-4: Invalidity Chart for U.S. Pat. No. 10,844,697 in view of the Select Fire System; dated Aug. 30, 2021; 32 pages.
Perfx's Wireline Services, LLC; Exhibit A-5: Invalidity Chart for U.S. Pat. No. 10,844,697 in view of U.S. Pat. No. 5,042,594; dated Aug. 30, 2021; 27 pages.
Perfx's Wireline Services, LLC; Exhibit A-6: Invalidity Chart for U.S. Pat. No. 10,844,697 in view of U.S. Pat. No. 4,007,796; dated Aug. 30, 2021; 23 pages.
Perfx's Wireline Services, LLC; Exhibit A-7: Invalidity Chart for U.S. Pat. No. 10,844,697 in view of U.S. Pat. No. 9,145,764; dated Aug. 30, 2021; 36 pages.
Perfx's Wireline Services, LLC; Exhibit A-8: Invalidity Chart for U.S. Pat. No. 10,844,697 in view of U.S. Pat. No. 10,077,6414; dated Aug. 30, 2021; 29 pages.
Perfx's Wireline Services, LLC; Exhibit A-9: Invalidity Chart for U.S. Pat. No. 10,844,697 in view of the SafeJet System; dated Aug. 30, 2021; 18 pages.
Perfx's Wireline Services, LLC; Exhibit B-1: Invalidity Chart for U.S. Pat. No. D904,475 in view of the Dynawell Tandem Sub; dated Aug. 30, 2021; 10 pages.
Perfx's Wireline Services, LLC; Exhibit B-2: Invalidity Chart for U.S. Pat. No. D904,475 in view of the LRI Tandem Subassembly; dated Aug. 30, 2021; 12 pages.
Perfx's Wireline Services, LLC; Exhibit B-3: Invalidity Chart for U.S. Pat. No. D904,475 in view of the Owen Oil Tools Tandem Sub; dated Aug. 30, 2021; 10 pages.
Perfx's Wireline Services, LLC; Exhibit B-4: Invalidity Chart for U.S. Pat. No. D904,475 in view of the XConnect Tandem Sub; dated Aug. 30, 2021; 1 page.
Perfx's Wireline Services, LLC; Exhibit B-5: Invalidity Chart for U.S. Pat. No. D904,475 in view of the SafeJet Disposable Bulkhead; dated Aug. 30, 2021; 15 pages.
Perfx's Wireline Services, LLC; Exhibit B-6: Invalidity Chart for U.S. Pat. No. D904,475 in view of Chinese Patent Application No. CN110424930A; dated Aug. 30, 2021; 9 pages.
Perfx's Wireline Services, LLC; Exhibit B-7: Invalidity Chart for U.S. Pat. No. D904,475 in view of U.S. Patent Publication No. 2020/0308938; dated Aug. 30, 2021; 8 pages.
Perfx's Wireline Services, LLC; Xconnect, LLC's Preliminary Invalidity Contentions for Civil Action No. 6:21-cv-00371-ADA; dated Aug. 30, 2021; 7 pages.
Preiss Frank et al.; Lowering Total Cost of Operations Through Higher Perforating Efficiency while simultaneously enhancing safety; May 10, 2016; 26 pages.
Repeat Precision, LLC; Plaintiff Repeat Precision, LLC's Responsive Claim Construction Brief for Civil Action No. 6:21-cv-104-ADA, Public Version; dated Oct. 27, 2021; 21 pages.
Resilience Against Market Volatility Results Presentation; Exhibit 2015 of PGR No. 2020-00080; dated Jun. 30, 2020; 26 pages.

(56) References Cited

OTHER PUBLICATIONS

Robert Parrott, Case IPR2018-00600 for U.S. Pat. No. 9,581,422 B2, Declaration regarding Patent Invalidity, dated Jun. 29, 2020, 146 pages.
Rodgers, John; Claim Construction Declaration for Civil Action No. 3:21-cv-00185; dated Sep. 28, 2021; 41 pages.
Rodgers, John; Claim Construction Declaration for Civil Action No. 3:21-cv-00188; dated Sep. 28, 2021; 42 pages.
Rodgers, John; Declaration for Civil Action No. 3:20-CV-00376; dated Jul. 8, 2021; 32 pages.
Rodgers, John; Declaration for Civil Action No. 3:21-cv-00192-M; dated May 27, 2021; 42 pages.
Rodgers, John; Declaration for PGR No. 2021-00089; dated Sep. 16, 2021; 93 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Rodgers, John; Declaration for PGR2021-00078; dated Aug. 19, 2021; 137 pages.
Rodgers, John; Declaration of John Rodgers, Ph.D for PGR Case No. PGR2021-00097; dated Oct. 28, 2021; 124 pages.
Rodgers, John; Videotaped Deposition of John Rodgers; dated Jul. 29, 2021; 49 pages.
Salt Warren et al.; New Perforating Gun System Increases Safety and Efficiency; dated Apr. 1, 2016; 11 pages.
Salt, et al.; New Perforating Gun System Increases Saftey and Efficiency; Journal of Petroleum Technology; dated Apr. 1, 2016; Weatherford; https://jpt.spe.org/new-perforating-gun-system-increases-safety-and-efficiency; 11 pages.
Scharf Thilo; Declaration for PGR2020-00080; dated Nov. 16, 2020; 16 pages.
Scharf, Thilo; Declaration for PGR No. 2021-00089; dated Sep. 16, 2021; 8 pages.
International Searching Authority; International Search Report and Written Opinion for PCT App. No. PCT/EP2015/059381; Nov. 23, 2015; 14 pages.
International Searching Authority; International Search Report and Written Opinion for PCT App. No. PCT/EP2019/072064; Nov. 20, 2019; 15 pages.
International Searching Authority; International Search Report and Written Opinion for PCT App. No. PCT/US2015/018906; Jul. 10, 2015; 12 pages.
International Searching Authority; International Search Report and Written Opinion for PCT Application No. EP2020066327; mailed on Jan. 11, 2021; 17 pages.
International Searching Authority; International Search Report and Written Opinion of the International Searching Authority for PCT/EP2020/085622; mailed on Apr. 1, 2021; 10 pages.
International Searching Authority; International Search Report and Written Opinion of the International Searching Authority for PCT/EP2021/057570; mailed on Sep. 13, 2021; 21 pages.
International Searching Authority; International Search Report and Written Opinion of the International Searching Authority for PCT/EP2021/057148; mailed on Jul. 5, 2021; 11 pages.
International Searching Authority; International Search Report and Written Opinion of the International Searching Authority for PCT/EP2021/058182; mailed on Aug. 26, 2021; 16 pages.
International Searching Authority; International Search Report and Written Opinion of the International Searching Authority for PCT/EP2020/085624; mailed on Apr. 12, 2021; 11 pages.
International Searching Authority; International Searching Authority Partial Search Report and Invitation to Pay Additional Search Fees for PCT/EP2021/057570; mailed on Jul. 22, 2021; 17 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
Lehr, Doug; Declaration of Doug Lehr in Supprt of Repeat Precision's Response Claim Construction Brief; dated Oct. 27, 2021; 35 pages.
Logan, et al.; International Patent Application No. PCT/CA2013/050986; dated Dec. 18, 2013; 54 pages.
Markel, Dan; Declaration regarding the SafeJet System for PGR2021-00097; dated Jul. 15, 2021; 21 pages.
Mcnelis et al.; High-Performance Plug-and-Perf Completions in Unconventional Wells; Society of Petroleum Engineers Annual Technical Conference and Exhibition; Sep. 28, 2015.
Meehan, Nathan; Declaration of D. Nathan Meehan, Ph.D, P.E; dated Oct. 18, 2021; 86 pages.
merriam-webster.com, Insulator Definition, https://www.merriam-webster.com/dictionary/insulator, Jan. 31, 2018, 4 pages.
Nextier Completion Solutions Inc.; Defendant NexTier Completion Solution Inc.'s Opening Claim Construction Brief; dated Oct. 18, 2021; 26 pages.
Nextier Completion Solutions Inc.; Defendant Nextier Completion Solutions Inc.'s First Amended Answer and Counterclaims to Plaintiffs' First Amended Complaint for Civil Action No. 6:20-CV-01201; dated Jun. 28, 2021; 17 pages.
Nextier Completion Solutions Inc.; Defendant's Preliminary Invalidity Contentions for Civil Action No. 6:20-cv-01201-ADA; dated Aug. 30, 2021; 21 pages.
Nextier Completion Solutions Inc.; Exhibit A-9 Selective perforation: A Game Changer in Peforating Technology—Case Study; dated Aug. 30, 2021; 13 pages.
Nextier Completion Solutions; Plaintiffs Preliminary Invalidity Contentions for Civil Action No. 4:21-cv-01328; dated Jun. 30, 2021; 19 pages.
Nextier Oilfield Solutions Inc; Petition for Inter Partes Review No. IPR2021-00082; dated Oct. 21, 2020; 111 pages.
Nexus Perforating LLC; Answer to DynaEnergetics Europe GMBH and DynaEnergetics US Inc/'s Complaint and Counterclaims; dated Apr. 15, 2021; 10 pages.
Nexus Perforating LLC; Complaint and Demand for Jury Trial for Civil Case No. 4:20-cv-01539; dated Apr. 30, 2020; 11 pages.
Nexus Perforating LLC; Invalidity Contentions for Civil Action No. 4:21-cv-00280; dated Jun. 30, 2021; 44 pages.
Nexus Perforating LLC; Nexus Perforating LLC's Responsive Claim Construction Brief for Civil Action No. 4:21-cv-00280; dated Nov. 3, 2021; 31 pages.
Nexus Perforating LLC; Nexus Preliminary Claim Construction and Extrinsic Evidence for Civil Action No. 4:21-cv-00280; dated Aug. 4, 2021; 6 pages.
Norwegian Industrial Property Office; Notice of Allowance for No. U.S. Appl. No. 20/171,759; dated Apr. 23, 2021; 2 pages.
Norwegian Industrial Property Office; Office Action and Search Report for NO Appl. No. 20160017; Jun. 15, 2017; 5 pages.
Norwegian Industrial Property Office; Office Action and Search Report for NO App. No. 20171759; Jan. 14, 2020; 6 pages.
Norwegian Industrial Property Office; Office Action for NO Appl. 20160017; mailed Dec. 4, 2017; 2 pages.
Norwegian Industrial Property Office; Office Action for NO Appl. No. 20171759; mailed Oct. 30, 2020; 2 pages.
Norwegian Industrial Property Office; Office Action for NO Application No. 20210799; dated Oct. 30, 2021; 2 pages.
Norwegian Industrial Property Office; Opinion for NO Appl. No. 20171759; mailed Apr. 5, 2019; 1 page.
Oilfield Glossary; Definition of Perforating Gun; dated Feb. 26, 2013; 2 pages.
oilgasglossary.com; Definition of "sub"; dated Nov. 20, 2008; 1 page.

(56) References Cited

OTHER PUBLICATIONS

Olsen, Steve; Declaration regarding the SafeJet System for PGR2021-00097; dated Jul. 16, 2021; 25 pages.
Oso Perforating, LLC; Defendant's Preliminary Invalidity Contentions for Civil Action No. 3:21-cv-00188-M; dated Aug. 4, 2021; 23 pages.
OSO Perforating, LLC; Exhibit A1 U.S. Pat. No. 5,155,293 to Barton vs. Asserted Claims of U.S. Pat. No. 10,844,697; dated Aug. 4, 2021; 21 pages.
Owen Oil Tools & Pacific Scientific; RF-Safe Green Det, Side Block for Side Initiation, Jul. 26, 2017, 2 pgs.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools, Recommended Practice for Oilfield Explosive Safety, Presented at 2011 MENAPS Middle East and North Africa Perforating Symposium, Nov. 28-30, 2011, 6 pages.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
Scharf, Thilo; Declaration for PGR2020-00072; dated Oct. 22, 2020; 13 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger Technology Corporation, Defendant Schlumberger Technology Corporation's Opening Claim Construction Brief for Civil Action No. 6:21-cv-00225-ADA; dated Oct. 6, 2021; 27pages.
Schlumberger Technology Corporation; Defendant Schlumberger Technology Corporation's Reply To Plaintiffs' Responsive Claim Construction Brief; dated Nov. 10, 2021; 17 pages.
Schlumberger Technology Corporation; Defendant's Preliminary Invalidity Contentions; dated Aug. 19, 2021; 213 pages.
Schlumberger Technology Corporation; Exhibit A-01 to Defendant's Preliminary Invalidity Contentions Invalidity of U.S. Pat. No. 10,844,696 over WO20190148009; dated Aug. 19, 2021; 267 pages.
Schlumberger Technology Corporation; Exhibit A-02 to Defendant's Preliminary Invalidity Contentions Invalidity of U.S. Pat. No. 10,844,696 over U.S. Pat. No. 4,598,775; dated Aug. 19, 2021; 178 pages.
Schlumberger Technology Corporation; Exhibit A-03 to Defendant's Preliminary Invalidity Contentions Invalidity of U.S. Pat. No. 10,844,696 over U.S. Pat. No. 4,753,301; dated Aug. 19, 2021; 178 pages.
Schlumberger Technology Corporation; Exhibit A-04 to Defendant's Preliminary Invalidity Contentions Invalidity of U.S. Pat. No. 10,844,696 over U.S. Pat. No. 10,746,003; dated Aug. 19, 2021; 186 pages.
Schlumberger Technology Corporation; Exhibit A-05 to Defendant's Preliminary Invalidity Contentions Invalidity of U.S. Pat. No. 10,844,696 over WO2017/024266; dated Aug. 19, 2021; 247 pages.
Schlumberger Technology Corporation; Exhibit A-06 to Defendant's Preliminary Invalidity Contentions Invalidity of U.S. Pat. No. 10,844,696 over U.S. Pat. No. 4,479,556; dated Aug. 19, 2021; 250 pages.
Schlumberger Technology Corporation; Exhibit A-07 to Defendant's Preliminary Invalidity Contentions Invalidity of U.S. Pat. No. 10,844,696 over US2017/0145798; dated Aug. 19, 2021; 279 pages.
Schlumberger Technology Corporation; Petitioner's Reply to Patent Owner's Preliminary Response; dated Oct. 13, 2021; 14 pages.
Schlumberger; Field Test Database Print Out Showing uses of the SafeJet System; dated May 11, 2015; 10 pages.
Schlumberger; Lina Pradilla, Wireline Efficiency in Unconventional Plays—The Argentinean Experience, including excerpted image from slide 13; dated 2013; 16 pages http://www.perforators.org/wp-content/uploads/2015/10/SLAP_47_Wireline_Efficiency_Unconventional_Plays.pdf.
Schlumberger; Selective Perforation: A Game Changer in Perforating Technology—Case Study; issued 2012; 14 pages.
Sharma, Gaurav; Hunting Plc is Not in a Race to the Bottom, Says Oilfield Services Firm's CEO; dated Sep. 10, 2019; retrieved on Nov. 18, 2020; 6 pages.
Shelby Sullivan; Declaration of Shelby Sullivan; dated Oct. 18, 2021; 9 pages.
SIPO, Search Report dated Mar. 29, 2017, in Chinese: See Search Report for CN App. No. 201480040456.9, 12 pgs. (English Translation 3 pgs.).
Smithson, Anthony; Declaration Declaration for IPR2021-00082; dated Oct. 16, 2020; 2 pages.
Smylie, Tom, New Safe and Secure Detonators for the Industry's consideration, presented at Explosives Safety & Security Conference, Marathon Oil Co, Houston; Feb. 23-24, 2005, 20 pages.
State Intellectual Property Office People's Republic of China; First Office Action for Chinese App. No. 201811156092.7; issued Jun. 16, 2020; 6 pages (Eng Translation 8 pages).
State Intellectual Property Office, P.R. China; First Office Action for Chinese App No. 201580011132.7; issued Jun. 27, 2018; 5 pages (Eng. Translation 9 pages).
State Intellectual Property Office, P.R. China; First Office Action for CN App. No. 201480047092.7; issued on Apr. 24, 2017.
State Intellectual Property Office, P.R. China; First Office Action with full translation for CN App. No. 201480040456.9; issued Mar. 29, 2017; 12 pages (English translation 17 pages).
State Intellectual Property Office, P.R. China; Notification to Grant Patent Right for Chinese App. No. 201580011132.7; issued Apr. 3, 2019; 2 pages (Eng. Translation 2 pages).
State Intellectual Property Office, P.R. China; Notification to Grant Patent Right for CN App. No. 201480040456.9; Jun. 12, 2018; 2 pages (English translation 2 pages).
State Intellectual Property Office, P.R. China; Second Office Action for CN App. No. 201480040456.9; issued Nov. 29, 2017; 5 pages (English translation 1 page).
State Intellectual Property Office, P.R. China; Second Office Action for CN App. No. 201480047092.7; issued Jan. 4, 2018; 3 pages.
Stifel; Why the Big Pause? Balancing Long-Term Value with Near-Term Headwinds. Initiating Coverage of Oilfield Svcs and Equipment; dated Sep. 10, 2018; 207 pages.
SWM International, LLC and Nextier Completion Solutions LLC; Petitioner's Preliminary Reply to Patent Owner's Preliminary Response for Case No. PGR2021-00097; dated Nov. 15, 2021; 11 pages.
SWM International, LLC and Nextier Oil Completion Solutions, LLC; Petition for Post Grant Review PGR No. 2021-00097; dated Jul. 20, 2021; 153 pages.
SWM International, LLC; Defendant's P.R. 3-3 and 3-4 Preliminary Invalidity Contentions; dated Aug. 4, 2021; 28 pages.
SWM International, LLC; Defendant's P.R. 4-1 Disclosure of Proposed Terms and Claim Elements for Construction for Civil Action No. 3:21-cv-00192-M; dated Aug. 24, 2021; 5 pages.
SWM International, LLC; Ex. A-1 Invalidity of U.S. Pat. No. 10,844,697 Over the SafeJet System; dated Aug. 4, 2021; 15 pages.
SWM International, LLC; Ex. A-1A Invalidity of U.S. Pat. No. 10,844,697 Over the SafeJet System in view of Backhus; dated Aug. 4, 2021; 4 pages.
SWM International, LLC; Ex. A-1B Invalidity of U.S. Pat. No. 10,844,697 Over the SafeJet System in view of Harrigan; dated Aug. 4, 2021; 3 pages.
SWM International, LLC; Ex. A-2 Invalidity of U.S. Pat. No. 10,844,697 Over Goodman; dated Aug. 4, 2021; 11 pages.
SWM International, LLC; Ex. A-2A Invalidity of U.S. Pat. No. 10,844,697 Over Goodman in view of Backhus; dated Aug. 4, 2021; 3 pages.
SWM International, LLC; Ex. A-2B Invalidity of U.S. Pat. No. 10,844,697 Over Goodman in view of Harrigan; dated Aug. 4, 2021; 3 pages.
SWM International, LLC; Ex. A-3 Invalidity of U.S. Pat. No. 10,844,697 Over Harrigan; dated Aug. 4, 2021; 13 pages.

(56) References Cited

OTHER PUBLICATIONS

SWM International, LLC; Ex. A-4 Invalidity of U.S. Pat. No. 10,844,697 Over Burton; dated Aug. 4, 2021; 11 pages.
SWM International, LLC; Ex. A-5 Invalidity of U.S. Pat. No. 10,844,697 Over Rogman; dated Aug. 4, 2021; 10 pages.
SWM International, LLC; Exhibit B: DynaEnergetics' Infringement of U.S. Pat. No. 11,078,762 for Civil Action No. 6:21-cv-00804; dated Aug. 3, 2021; 22 pages.
SWM International; Drawing of SafeJet System; dated Jul. 20, 2021; 1 page.
SWM International; Photographs of SafeJet System; dated Jul. 20, 2021; 9 pages.
TOLTEQ; iSeries MWD System; dated 2021; 9 pages.
U.S. Patent Trial and Appeal Board, Institution of Inter Partes Review of U.S. Pat. No. 9,581,422, Case IPR2018-00600,Aug. 21, 2018, 9 pages.
United States District Court for the Northern District of Texas Dallas Division; Memorandum Opinion and Order in Civil Action No. 3:21-cv-00188-M; Mar. 23, 2022; 35 pages (order is redacted to protect confidential information; redacted order has not yet been filed by the Court).
United States District Court for the Northern District of Texas Dallas Division; Memorandum Opinion and Order in Civil Action No. 3:21-cv-00192-M; Mar. 23, 2022; 34 pages (order is redacted to protect confidential information; redacted order has not yet been filed by the Court).
Norwegian Industrial Property Office; Notice of Allowance issued for Norwegian U.S. Appl. No. 20210799; dated Aug. 18, 2025; 2 pages.
Amit Govil, Selective Perforation: A Game Changer in Perforating Technology—Case Study, presented at the 2012 European and West African Perforating Symposium, Schlumberger, Nov. 7-9, 2012, 14 pgs.
Austin Powder Company; A-140 F & Block, Detonator & Block Assembly; Jan. 5, 2017; 2 pgs .; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Bear Manufacturing, LLC; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Bear Manufacturing, LLC; Defendant's Preliminary Invalidity Contentions; dated Aug. 4, 2021; 23 pages.
Bear Manufacturing, LLC; Exhibit A1 U.S. Pat. 5,155,293 to Barton vs. Asserted Claims of U.S. Pat. No. 10,844,697; dated Aug. 4, 2021; 21 pages.
Bear Mfg and Oso Perf, Invalidity Contentions in Litigation re Amit Govil, "Selective Perforation: A Game Changer in Perforating Technology—Case Study," 2012 European and West African Perforating Symposium ("EWAPS") vs. Asserted Claims of U.S. Pat. No. 10,844,697, dated as early as Aug. 4, 2021, 17 pgs.
Bear Mfg and Oso Perf, Invalidity Contentions in Litigation re U.S. Pat. No. 9,175,553 to McCann, et al. vs. Asserted Claims of U.S. Pat. No. 10,844,697, dated as early as Aug. 4, 2021, 26 pgs.
Bear Mfg, Oso Perf, Horizontal Wireline and Allied Horizontal, Invalidity Chart in Litigation re U.S. Pat. No. 10,844,697, USPN 6,506,083 vs. Asserted Claims, dated as early as Aug. 4, 2021, 17 pgs.
Bear Mfg, Oso Perf, Horizontal Wireline and Allied Horizontal, Invalidity Contentions in Litigation re U.S. Pat. No. 10,844,697, "New Select-Fire System" Publication and Select-Fire System by BakerHughes vs. Asserted Claims, dated as early as Aug. 4, 2021, 14 pgs.
Bear Mfg, Oso Perf, Horizontal Wireline and Allied Wireline, Invalidity Chart in Litigation re U.S. Pat. No. 10,844,697, US Pub. No. 2012/0247771 vs. Asserted Claims, dated as early as Aug. 4, 2021, 26 pgs.
Bear Mfg, Oso Perf, Horizontal Wireline and Allied Wireline, Invalidity Contentions in Litigation re "3.12-in Frac Gun" Publication and 3.12-in Frac Gun System by Sclumberger vs. Asserted Claims of U.S. Pat. No. 10,844,697, dated as early as Aug. 4, 2021, 26 pgs.
Bear Mfg, Oso Perf, Horizontal Wireline and Allied Wireline, Invalidity Contentions in Litigation re Schlumberger SafeJet System vs. Asserted Claims of U.S. Pat. No. 10,844,697, dated as early as Aug. 4, 2021, 26 pgs.
Bear Mfg, Oso Perf, Horizontal Wireline and Allied Wireline, Invalidity Contentions in Litigation re U.S. Publication 2012/0199352 to Lanclos vs. Asserted Claims of U.S. Pat. No. 10,844,697, dated as early as Aug. 4, 2021, 24 pgs.
Bear Mfg, Oso Perf, Horizontal Wireline and Allied Wireline, Invalidity Contentions in Litigation re U.S. Publication No. 2008/0073081 to Frazier, et al vs. Asserted Claims of U.S. Pat. No. 10,844,697, dated as early as Aug. 4, 2021, 33 pgs.
Bear Mfg, Oso Perf, Horizontal Wireline and Allied Wireline, Invalidity Contentions in Litigation re U.S. Publication No. 2016/0084048 to Harrigan, et al vs. Asserted Claims of U.S. Pat. No. 10,844,697, dated as early as Aug. 4, 2021, 14 pgs.
Bear Mfg, Oso Perf, Horizontal Wireline and Allied Wireline, Invalidity Contentions in Litigation re U.S. Publication No. 2010/0065302 to Nesbitt vs. Asserted Claims of U.S. Pat. No. 10,844,697, dated as early as Aug. 4, 2021, 15 pgs.
Bear Mfg, Oso Perf, Horizontal Wireline and Allied Wireline, Invalidity Contentions in Litigation re U.S. Pat. No. 3,173,992 to Boop vs. Asserted Claims of U.S. Pat. No. 10,844,697, dated as early as Aug. 4, 2021, 17 pgs.
Bear Mfg, Oso Perf, Horizontal Wireline and Allied Wireline, Invalidity Contentions in Litigation re U.S. Pat. No. 4,457,383 to Boop. vs. Asserted Claims of U.S. Pat. No. 10,844,697, dated as early as Aug. 4, 2021, 22 pgs.
Bear Mfg, Oso Perf, Horizontal Wireline and Allied Wireline, Invalidity Contentions in Litigation re U.S. Pat. No. 6,582,251 to Burke, et al.vs. Asserted Claims of U.S. Pat. No. 10,844,697, dated as early as Aug. 4, 2021, 15 pgs.
Bear Mfg, Oso Perf, Horizontal Wireline and Allied Wireline, Invalidity Contentions in Litigation re U.S. Pat. No. 7,762,331 to Goodman vs. Asserted Claims of U.S. Pat. No. 10,844,697, dated as early as Aug. 4, 2021, 28 pgs.
Bear Mfg, Oso Perf, Horizontal Wireline and Allied Wireline, Invalidity Contentions in Litigation re U.S. Pat. No. 7,901,247 to Ring vs. Asserted Claims of U.S. Pat. No. 10,844,697, dated as early as Aug. 4, 2021, 19 pgs.
Bear Mfg, Oso Perf, Horizontal Wireline and Allied Wireline, Invalidity Contentions in Litigation re U.S. Pat. No. 8,387,533 to Runkel vs. Asserted Claims of U.S. Pat. No. 10,844,697, dated as early as Aug. 4, 2021, 16 pgs.
Bear Mfg, Oso Perf, Horizontal Wireline and Allied Wireline, Invalidity Contentions in Litigation re U.S. Pat. No. 8,869,887 to Deere, et al.vs. Asserted Claims of U.S. Pat. No. 10,844,697, dated as early as Aug. 4, 2021, 10 pgs.
Bear Mfg, Oso Perf, Horizontal Wireline and Allied Wireline, Invalidity Contentions in Litigation re U.S. Pat. No. 8,943,943 to Tassaroli vs. Asserted Claims of U.S. Pat. No. 10,844,697, dated as early as Aug. 4, 2021, 7 pgs.
Bear Mfg, Oso Perf, Horizontal Wireline and Allied Wireline, Invalidity Contentions in Litigation re U.S. Pat. No. 9,065,201 to Borgfeld, et al. vs. Asserted Claims of U.S. Pat. No. 10,844,697, dated as early as Aug. 4, 2021, 14 pgs.
Bear Mfg, Oso Perf, Horizontal Wireline and Allied Wireline, Invalidity Contentions in Litigation re U.S. Pat. No. 9,145,764 to Burton, et al. vs. Asserted Claims of U.S. Pat. No. 10,844,697, dated as early as Aug. 4, 2021, 18 pgs.
Bear Mfg, Oso Perf, Horizontal Wireline and Allied Wireline, Invalidity Contentions in Litigation re U.S. Pat. No. 9,689,223 to Schacherer, et al. vs. Asserted Claims of U.S. Pat. No. 10,844,697, dated as early as Aug. 4, 2021, 8 pgs.
Brazilian Patent and Trademark Office; Search Report for BR Application No. BR112015033010-0; mailed May 5, 2020; (4 pages).

(56) References Cited

OTHER PUBLICATIONS

Brico Oil Tools; Bt Tool Inspection, Care and Maintenance Guideline; Setting Tool Inspection Information Product Family No. 41-21; dated Jan. 11, 2014; https://www.bricooiltools.com/pdfs/Brico-Setting-Tool-Inspection-manual.pdf.
Brinsden, Mark; Declaration of Mark Brinsden; dated Sep. 30, 2021; 51 pages.
Buche & Associates, P.C.; Rule 501 Citation of Prior Art and Written "Claim Scope Statements" in U.S. Pat. No. 10,844,697; dated Mar. 3, 2021; 24 pages.
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
C&J Energy Services; Gamechanger Perforating System Description; 2018; 1 pages.
C&J Energy Services; Gamechanger Perforating System Press Release; 2018; 4 pages.
Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; mailed Jul. 31, 2019; 1 page.
Canadian Intellectual Property Office; Office Action for CA Appl. No. 2,821,506; mailed Mar. 21, 2019; 4 pages.
Canadian Intellectual Property Office; Office Action for CA Application No. 2,941,648; dated Mar. 15, 2021; 3 pages.
Canadian Intellectual Property Office; Office Action for CA Application No. 3,070, 118; dated Mar. 16, 2021; 3 pages.
Canadian Intellectual Property Office; Office Action for CA Application No. 3,070, 118; dated Nov. 17, 2021; 3 pages.
Canadian Intellectual Property Office; Office Action for CA Application No. 3040648; dated Nov. 18, 2020; 4 pages.
ControlFire User Manual; Exhibit No. 2005 of PGR No. 2020-00072; 2014; 56 pages.
Corelab Owen Oil Tools; Expendable Perforating Guns Description; https://www.corelab.com/owen/cms/docs/Canada/10A_erhsc-01.0-c.pdf; 2008; 7 pages.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Djresource, Replacing Signal and Ground Wire, May 1, 2007, 2 pages, http://www.djresource.eu/Topics/story/110/Technics-SL-Replacing-Signal-and-Ground-Wire/.
drillingmatters.org; Definition of "sub"; dated Aug. 25, 2018; 2 pages.
Dynaenergetics Europe GMBH, Oso Perforating, LLC, SWM International, LLC and Bear Manufacturing, LLC; Joint Claim Construction Statement for Northern District of Texas Civil Action Nos. 3:21-cv-00188, 3:21-cv-00192 and 3:21-cv-00185; dated Sep. 28, 2021; 29 pages.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States District Court for the Southern District of Texas; Joint Claim Construction Statement for Civil Action No. 3:20-cv-00376; dated Jul. 8, 2021; 14 pages.
United States District Court for the Southern District of Texas; Joint Claim Construction Statement for Civil Action No. 4:20-cv-02123; dated Aug. 27, 2021; 14 pages.
United States District Court for the Western District of Texas; Order Granting in Part & Denying on Part Defendants' Motion to Dismiss for Improper Venue or to Transfer Venue Pursuant to 28 U.S.C. § 1404(a) for Civil Action No. 6:20-CV-01110-ADA; dated Aug. 5, 2021; 16 pages.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of Patent No. 9,581,422, dated Mar. 7, 2019, 44 pgs.
United States Patent and Trademark Office, Final Office Action of U.S. Appl. No. 16/359,540, dated Aug. 14, 2019, 9 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-Final Office Action of U.S. Appl. No. 16/451,440, dated Oct. 24, 2019, 22 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/117,228, dated May 31, 2018, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/788,367, dated Oct. 22, 2018, 6 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/026,431, dated Jul. 30, 2019, 10 pages.
United States Patent and Trademark Office, Non-Final Office Action of U.S. Appl. No. 16/359,540, dated May 3, 2019, 11 pages.
United States Patent and Trademark Office, Non-Final Office Action of U.S. Appl. No. 16/455,816, dated Nov. 5, 2019, 17 pages.
United States Patent and Trademark Office, Notice of Allowance for U.S. Appl. No. 15/920,800, dated Jul. 7, 2020, 7 pages.

(56) References Cited

OTHER PUBLICATIONS

United States Patent and Trademark Office, Notice of Allowance for U.S. Appl. No. 16/585,790, dated Jun. 19, 2020, 16 pages.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Pat. No. 438305A, issued on Oct. 14, 1890 to T.A. Edison, 2 pages.
United States Patent and Trademark Office: U.S. Pat. No. 10,458,213; dated Feb. 11, 2019; 333 pages.
United States Patent and Trademark Office; Final Office Action of U.S. Appl. No. 16/809,729, dated Nov. 3, 2020; 19 pages.
United States Patent and Trademark Office; Decision Granting Institution of Post-Grant Review 35 U.S.C. § 324 for PGR2021-00078; dated Nov. 1, 2021; 87 pages.
United States Patent and Trademark Office; Ex Parte Quayle Action for U.S. Appl. No. 16/809,729; dated Jun. 20, 2022; 4 pages.
United States Patent and Trademark Office; Ex Parte Quayle Action for U.S. Appl. No. 16/924,504; dated Aug. 18, 2021; 9 pages.
United States Patent and Trademark Office; Ex Parte Quayle Action for U.S. Appl. No. 17/352,728; dated Jun. 20, 2022; 6 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 16/540,484; dated Apr. 27, 2022; 12 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 16/809,729; dated Nov. 18, 2021; 16 pages.
United States Patent and Trademark Office; Final Office Action for U.S. Appl. No. 17/004,966; dated Mar. 12, 2021; 18 pages.
Hunting Energy Service, ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, Electrical Cable Heads, May 8, 2016, 4 pgs., http://www.hunting-intl.com/media/1967991/ElectricalCableHeads.pdf.
Hunting Titan, H-1 Perforating System, Sep. 1, 2017, 3 pgs., http://www.hunting-intl.com/titan/perforating-guns-and-setting-tools/h-1%C2%AE-perforating-system.
Hunting Titan, Inc.; Defendant Hunting Titan, Inc.'s Opposition to Plaintiff's Motion for Summary Judgement for Civil Action No. 4:20-cv-02123; dated Mar. 30, 2022; 37 pages.
Hunting Titan, Inc.; Defendant Hunting Titan, Inc.'s Opposed Motion for Leave to Amend Invalidity Contentions for Civil Action No. 4:20-cv-02123; dated Nov. 19, 2021; 17 pages.
Hunting Titan, Inc.; Defendant's Answer, Affirmative Defenses, and Counterclaims to Plaintiffs' Second Amended Complaint for Civil Action No. 4:20-cv-02123; dated Sep. 10, 2021; 77 pages.
Hunting Titan, Inc.; Defendant's Final Invalidity Contentions for Civil Action No. 4:20-cv-02123; dated Jan. 7, 2022; 54 pages.
Hunting Titan, Inc.; Defendant's Preliminary Invalidity Contentions for Civil Action No. 4:20-cv-02123; dated Aug. 6, 2021; 52 pages.
Hunting Titan, Inc.; Defendant's Responsive Claim Construction Brief for Civil Action No. 4:20-cv-02123; dated Oct. 1, 2021; 31 pages.
Hunting Titan, Inc.; Defendant's Supplemental Brief on Claim Construction; dated Nov. 5, 2021; 9 pages.
Hunting Titan, Inc.; Exhibit 1 to Defendant Hunting Titan, Inc.'s Opposed Motion for Leave to Amend Invalidity Contentions for Civil Action No. 4:20-cv-02123; dated Nov. 19, 2021; 64 pages.
Hunting Titan, Inc.; Exhibit 2 to Defendant Hunting Titan, Inc.'s Opposed Motion for Leave to Amend Invalidity Contentions for Civil Action No. 4:20-cv-02123; dated Nov. 19, 2021; 33 pages.
Hunting Titan, Inc.; Exhibit 3 to Defendant Hunting Titan, Inc.'s Opposed Motion for Leave to Amend Invalidity Contentions for Civil Action No. 4:20-cv-02123; dated Nov. 19, 2021; 24 pages.
Hunting Titan, Inc.; Exhibit 4 to Defendant Hunting Titan, Inc.'s Opposed Motion for Leave to Amend Invalidity Contentions for Civil Action No. 4:20-cv-02123; dated Nov. 19, 2021; 9 pages.
Hunting Titan, Inc.; Exhibit 5 to Defendant Hunting Titan, Inc.'s Opposed Motion for Leave to Amend Invalidity Contentions for Civil Action No. 4:20-cv-02123; dated Nov. 19, 2021; 5 pages.
Hunting Titan, Inc.; Exhibit 6 to Defendant Hunting Titan, Inc.'s Opposed Motion for Leave to Amend Invalidity Contentions for Civil Action No. 4:20-cv-02123; dated Nov. 19, 2021; 4 pages.
Hunting Titan, Inc.; Exhibit 7 to Defendant Hunting Titan, Inc.'s Opposed Motion for Leave to Amend Invalidity Contentions for Civil Action No. 4:20-cv-02123; dated Nov. 19, 2021; 6 pages.
Hunting Titan, Inc.; Exhibit A to Defendant's Preliminary Invalidity Contentions, Invalidity of U.S. Pat. No. 10,429,161; dated Aug. 6, 2021; 93 pages.
Hunting Titan, Inc.; Exhibit B to Defendant's Preliminary Invalidity Contentions, Invalidity of U.S. Pat. No. 10,472,938; dated Aug. 6, 2021; 165 pages.
Hunting Titan, Inc.; Exhibit C to Defendant's Final Invalidity Contentions, Invalidity of U.S. Pat. No. 10,429,161; dated Jan. 7, 2022; 3 pages.
Hunting Titan, Inc.; Exhibit D to Defendant's Final Invalidity Contentions, Invalidity of U.S. Pat. No. 10,472,938; dated Jan. 7, 2022; 6 pages.
Hunting Titan, Inc; Petitioner's Sur-Reply on Patent Owner's Motion to Amend for IPR No. 2018-00600; dated Apr. 11, 2019; 17 pages.
Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Titan; Response to Canadian Office Action for CA App. No. 2,933,756; dated Nov. 23, 2017; 18 pages.
Industrial Property Office, Czech Republic; Office Action for CZ App. No. PV 2017-675; Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; Oct. 26, 2018; 2 pages.

(56) References Cited

OTHER PUBLICATIONS

Industrial Property Office, Czech Republic; Office Action; CZ App. No. PV 2017-675; Dec. 17, 2018; 2 pages.
Intellectual Property India, Office Action of IN Application No. 201647004496, dated Jun. 7, 2019, 6 pgs.
International Bureau; International Preliminary Report on Patentability for PCT Application #PCT/EP2019/063214; dated Dec. 24, 2020; 9 pages.
International Searching Authority, International Preliminary Report on Patentability for PCT App. No.PCT/EP2014/065752; Mar. 1, 2016, 10 pgs.
International Searching Authority, International Search and Written Opinion of International App. No. PCT/EP2020/058241, dated Aug. 10, 2020, 18 pgs.
International Searching Authority, International Search Report for International App No. PCT/EP2020/063214, Jul. 29, 2020, 17 pages.
International Searching Authority; Communication Relating to the Results of the Partial International Search for PCT/EP2020/070291; Oct. 20, 2020; 8 pages.
International Searching Authority; International Preliminary Report on Patentability for PCT Appl. No. PCT/CA2014/050673; issued Jan. 19, 2016; 5 pages.
International Searching Authority; International Preliminary Report on Patentability for PCT Application No. PCT/EP2019/069165; mailed on Jan. 28, 2021; 9 pages.
International Searching Authority; International Preliminary Report on Patentability for PCT Application No. PCT/IB2019/000569; dated Jan. 28, 2021; 8 pages.
International Searching Authority; International Search Report and Written Opinion for International Application No. PCT/US19/15255; dated Apr. 23, 2019; 12 pages.
International Searching Authority; International Search Report and Written Opinion for International Application No. PCT/US2020/032879; dated Aug. 20, 2020; 9 pages.
International Searching Authority; International Search Report and Written Opinion for PCT App. No. PCT/CA2014/050673; mailed Oct. 9, 2014; 7 pages.
United States Patent and Trademark Office; Final Office Action for U.S. Appl. No. 17/162,579; dated Jul. 15, 2022; 15 pages.
United States Patent and Trademark Office; Final Office Action for U.S. Appl. No. 17/352,728; dated Mar. 9, 2022; 9 pages.
United States Patent and Trademark Office; Final Office Action of U.S. Appl. No. 16/540,484; dated Mar. 30, 2020; 12 pgs.
United States Patent and Trademark Office; U.S. Pat. No. 9,581,422.
United States Patent and Trademark Office; Information Disclosure Statement for U.S. Appl. No. 16/293,508; dated Dec. 10, 2020; 7 pages.
United States Patent and Trademark Office; Non-Final Office Action for U.S. Appl. No. 16/542,890; issued Nov. 4, 2019; 16 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/540,484; dated Aug. 9, 2021; 12 pages.
United States Patent and Trademark Office; Non-Final Office Action for U.S. Appl. No. 16/809,729; dated Feb. 3, 2022; 6 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 16/819,270; dated Feb. 10, 2021; 13 pages.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/007,574; dated May 6, 2022; 10 pages.
United States Patent and Trademark Office; Non-Final Office Action for U.S. Appl. No. 17/123,972; dated Mar. 3, 2022; 9 pages.
United States Patent and Trademark Office; Non-Final Office Action for U.S. Appl. No. 17/162,579; dated Feb. 28, 2022; 16 pages.
United States Patent and Trademark Office; Non-Final Office Action for U.S. Appl. No. 17/181,280; dated Apr. 19, 2021; 18 pages.
United States Patent and Trademark Office; Non-Final Office Action for U.S. Appl. No. 17/206,416; dated May 19, 2021; 10 pages.
United States Patent and Trademark Office; Non-Final Office Action for U.S. Appl. No. 17/221,219; dated Jun. 17, 2021; 10 pages.
United States Patent and Trademark Office; Non-Final Office Action for U.S. Appl. No. 17/352,728; dated Oct. 25, 2021; 9 pages.
United States Patent and Trademark Office; Non-Final Office Action for U.S. Appl. No. 17/383,816; dated Jan. 25, 2022; 23 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 29/733,080; Oct. 20, 2020; 9 pages.
United States Patent and Trademark Office; Notice of Allowance for U.S. Appl. No. 16/858,041; dated Oct. 22, 2020; 10 pages.
United States Patent and Trademark Office; Notice of Allowance for U.S. Appl. No. 29/733,325; dated Oct. 23, 2020; 7 pages.
United States Patent and Trademark Office; Notice of Allowance for U.S. Appl. No. 15/920,812, mailed Aug. 18, 2020; 5 pages.
United States Patent and Trademark Office; Notice of Allowance for U.S. Appl. No. 16/387,696; issued on Jan. 29, 2020; 7 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 16/379,341; dated Jan. 19, 2021; 8 pages.
United States Patent and Trademark Office; Notice of Allowance for U.S. Appl. No. 16/423,789; dated Jul. 23, 2020 7 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 16/886,257; dated Sep. 15, 2021; 9 pages.
United States Patent and Trademark Office; Notice of Allowance for U.S. Appl. No. 17/004,966; dated Nov. 8, 2021; 12 pages.
United States Patent and Trademark Office; Notice of Allowance for U.S. Appl. No. 17/007,574; dated May 21, 2021; 8 pages.
United States Patent and Trademark Office; Notice of Allowance for U.S. Appl. No. 17/176,335; dated Jul. 13, 2022; 7 pages.
United States Patent and Trademark Office; Notice of Allowance for U.S. Appl. No. 17/181,280; dated Sep. 15, 2021; 14 pages.
United States Patent and Trademark Office; Notice of Allowance for U.S. Appl. No. 17/206,416; dated Sep. 9, 2021; 8 pages.
United States Patent and Trademark Office; Notice of Allowance for U.S. Appl. No. 17/221,219; dated Jan. 13, 2022; 11 pages.
United States Patent and Trademark Office; Notices of Allowabilty for U.S. Appl. No. 16/585,790; dated Jul. 31, 2020 and Mar. 18, 2020; Response to Office Action for U.S. Appl. No. 16/585,790; dated Nov. 12, 2019; 26 pages.
United States Patent and Trademark Office; Office Action and Response to Office Action for U.S. Appl. No. 16/585,790; dated Nov. 12, 2019 and Feb. 12, 2020; 21 pages.
United States Patent and Trademark Office; Office Action for U.S. Appl. No. 17/004,966; dated Dec. 8, 2020; 30 pages.
United States Patent and Trademark Office; Office Action in Ex Parte Reexamination for U.S. Pat. No. 10,844,697; mailed Jan. 26, 2022; 10 pages.
United States Patent and Trademark Office; Office Action of U.S. Appl. No. 16/540,484, dated Aug. 20, 2020, 10 pgs.
United States Patent and Trademark Office; Order Granting Request for Ex Parte Reexamination; dated Nov. 1, 2021; 14 pages.
United States Patent and Trademark Office; Patent Assignment for U.S. Appl. No. 61/733,129; dated Jan. 25, 2013; 2 pages.
United States Patent and Trademark Office; Prosecution History for U.S. Pat. No. 10,352,136 as of Jul. 16, 2019; 206 pages.
United States Patent and Trademark Office; Restriction Requirement for U.S. Appl. No. 17/007,574; dated Oct. 23, 2020; 6 pages.
U.S. Appl. No. 61/739,592; dated Dec. 19, 2012; 65 pages.

* cited by examiner

FIG. 4
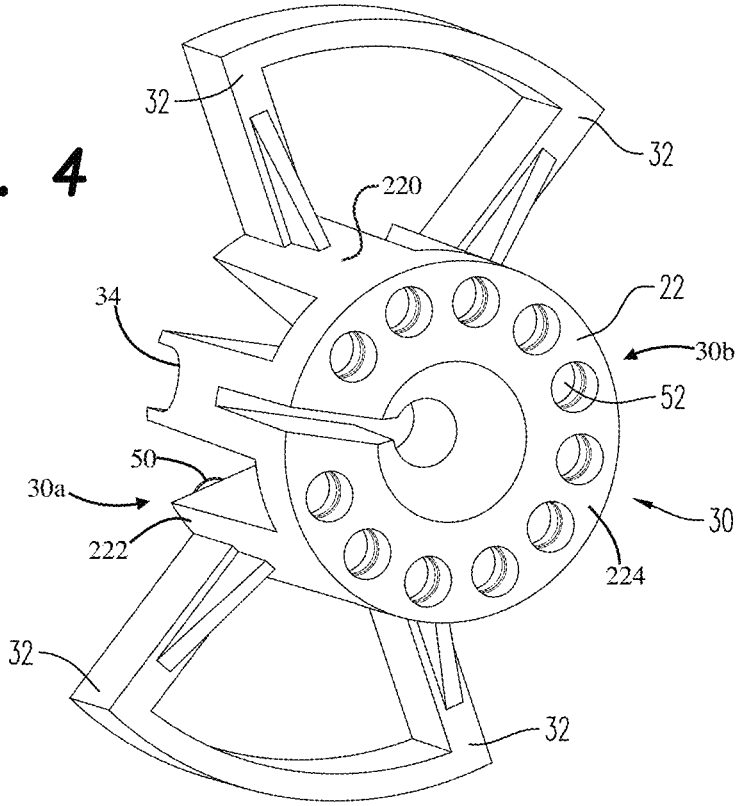
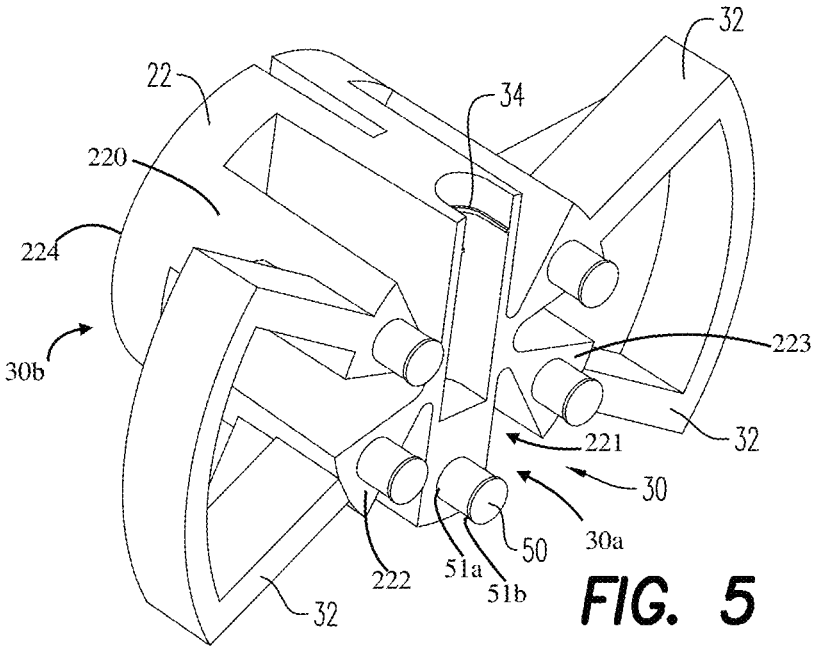
FIG. 5

FIG. 29
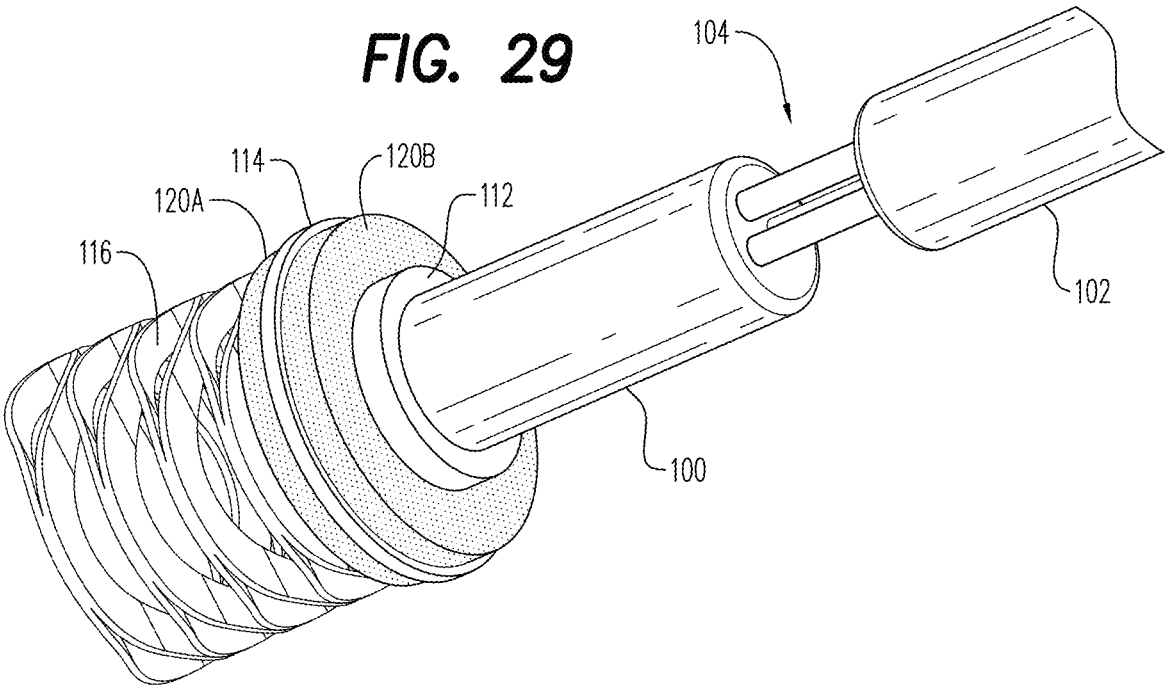
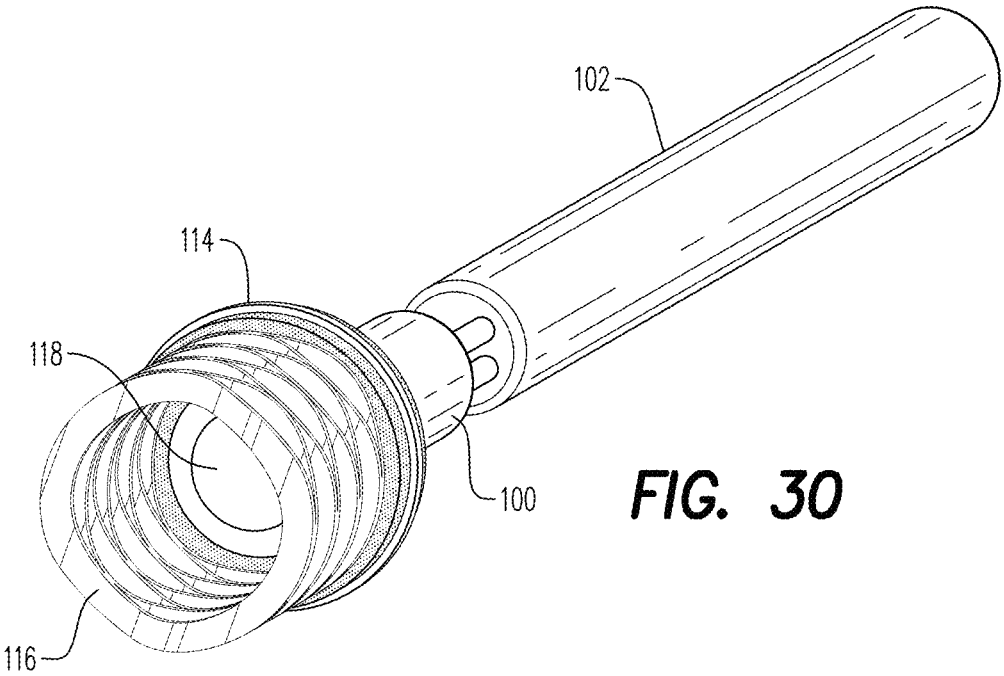
FIG. 30

PERFORATING GUN ORIENTATION SYSTEM

CROSS-REFERENCE TO RELATED APPLICATIONS

This application is a continuation of U.S. patent application Ser. No. 17/875,585 filed Jul. 28, 2022, which is a continuation of U.S. patent application Ser. No. 17/352,728 filed Jun. 21, 2021 (now U.S. Pat. No. 11,661,823 issued May 30, 2023), which is a continuation of U.S. patent application Ser. No. 17/221,219 filed Apr. 2, 2021 (now U.S. Pat. No. 11,788,389 issued Oct. 17, 2023), which is a continuation of U.S. patent application Ser. No. 17/007,574 filed Aug. 31, 2020 (now U.S. Pat. No. 11,542,792 issued Jan. 3, 2023), which is a continuation of U.S. patent application Ser. No. 16/809,729 filed Mar. 5, 2020 (now U.S. Pat. No. 11,608,720 issued Mar. 21, 2023), which is a continuation of U.S. patent application Ser. No. 16/585,790 filed Sep. 27, 2019 (now U.S. Pat. No. 10,844,697 issued Nov. 24, 2020), which is a continuation of U.S. patent application Ser. No. 16/359,540 filed Mar. 20, 2019 (now U.S. Pat. No. 10,472,938 issued Nov. 12, 2019), which is a continuation of U.S. patent application Ser. No. 15/920,812 filed Mar. 14, 2018 (now U.S. Pat. No. 11,125,056 issued Sep. 21, 2021), which is a continuation of U.S. patent application Ser. No. 15/617,344 filed Jun. 8, 2017 (now U.S. Pat. No. 10,429,161 issued Oct. 1, 2019), which is a divisional patent application of U.S. patent application Ser. No. 15/287,309 filed Oct. 6, 2016 (now U.S. Pat. No. 9,702,680 issued Jul. 11, 2017), which is a divisional patent application of U.S. patent application Ser. No. 14/904,788 filed Jan. 13, 2016 (now U.S. Pat. No. 9,494,021 issued Nov. 15, 2016), which is a U.S. national stage entry of PCT Application No. PCT/CA2014/050673 filed Jul. 16, 2014, which claims priority to Canadian Patent Application No. 2,821,506 filed Jul. 18, 2013, each of which is incorporated herein by reference in its entirety.

FIELD

A perforation gun system is generally described. More particularly, various perforation gun components that can be modularly assembled into a perforation gun system, the assembled perforated gun system itself, a perforation gun system kit, and a method for assembling a perforation gun system are generally described.

BACKGROUND

Perforation gun systems are used in well bore perforating in the oil and natural gas industries to tie a bore hole with a storage horizon within which a storage reservoir of oil or natural gas is located.

A typical perforation gun system consists of an outer gun carrier, arranged in the interior of which there are perforators-usually hollow or projectile charges—that shoot radially outwards through the gun carrier after detonation. Penetration holes remain in the gun carrier after the shot.

In order to initiate the perforators, there is a detonating cord leading through the gun carrier that is coupled to a detonator.

Different perforating scenarios often require different phasing and density of charges or gun lengths. Moreover, it is sometimes desirable that the perforators shooting radially outwards from the gun carrier be oriented in different directions along the length of the barrel. Therefore, phasing may be required between different guns along the length.

Onsite assembly of perforation gun systems may also be problematic under certain conditions as there are certain safety hazards inherent to the assembly of perforation guns due to the explosive nature of certain of its sub-components, including the detonator and the detonating cord.

There is thus a need for a perforation gun system, which by virtue of its design and components would be able to address at least one of the above-mentioned needs or overcome or at least minimize at least one of the above-mentioned drawbacks.

SUMMARY

An exemplary embodiment of a charge holder for use with a shaped charge may include a charge receiving structure configured to receive the shaped charge, a plurality of projections extending from the charge receiving structure and configured to retain the shaped charge within the charge receiving structure, and a rotation coupling configured to couple to an adjacent charge holder.

An exemplary embodiment of a charge holder assembly for use in a perforating gun may include a first charge holder and a second charge holder coupled to the first charge holder. The first charge holder may include a first charge receiving structure configured to receive a first shaped charge, a first plurality of projections extending from the first charge receiving structure and configured to retain the first shaped charge within the first charge receiving structure, and a first rotation coupling. The second charge holder may include a second charge receiving structure configured to receive a second shaped charge, a second plurality of projections extending from the second charge receiving structure and configured to retain the second shaped charge within the second charge receiving structure, and a second rotation coupling. The first rotation coupling may coupled to the second rotation coupling such that the first charge holder is rotatable with respect to the second charge holder.

An exemplary embodiment of a method of assembling a perforating gun string may include providing a first perforating gun assembly in a first gun carrier. The first perforating gun assembly may include a first top connector, one or more first charge holders, and at least one bottom connector. The method may include rotating the first top connector to align the one or more first charge holders in a zero-degree phasing and locking the position of the first top connector along the length of the first gun carrier. The method may include connecting the first gun carrier to a second gun carrier and providing in the second gun carrier a second perforating gun assembly including a second top connector, one or more second charge holders, and at least one second bottom connector. The method may include rotating the second top connector to align the one or more second charge holders in a zero-degree phasing and locking the position of the second top connector along the length of the second gun carrier.

An exemplary embodiment of a perforating gun may include a gun carrier, a charge holder assembly provided within the gun carrier, a first shaped charge and a second shaped charge received within the charge holder assembly, a detonating cord energetically coupled to each of the first shaped charge and the second shaped charge, and a detonator energetically coupled to the detonating cord. The charge holder assembly may include a first charge holder and a second charge holder. The first charge holder may include a first charge receiving structure configured to receive the first shaped charge, a first plurality of projections extending from the first charge receiving structure and configured to retain the first shaped charge within the first charge receiving structure, and a first rotation coupling. The second charge holder may include a second charge receiving structure configured to receive the second shaped charge, a second plurality of projections extending from the second charge receiving structure and configured to retain the second shaped charge within the second charge receiving structure, and a second rotation coupling. The first rotation coupling may be coupled to the second rotation coupling such that the first charge holder is rotatable with respect to the second charge holder.

BRIEF DESCRIPTION OF THE DRAWINGS

These and other objects and advantages will become apparent upon reading the detailed description and upon referring to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which:

FIG. 4 is a front perspective view of a bottom connector in accordance with an embodiment;

FIG. 5 is a rear perspective view of the bottom connector shown in FIG. 4;

FIG. 29 is another detailed perspective view of the detonator shown in FIG. 27;

FIG. 30 is another detailed perspective view of the detonator shown in FIG. 27;

DETAILED DESCRIPTION

In the following description and accompanying FIGS., the same numerical references refer to similar elements throughout the FIGS. and text. Furthermore, for the sake of simplicity and clarity, namely so as not to unduly burden the FIGS. with several reference numbers, only certain FIGS. have been provided with reference numbers, and components and features of the embodiments illustrated in other FIGS. can be easily inferred therefrom. The embodiments, geometrical configurations, and/or dimensions shown in the FIGS. are for exemplification purposes only. Various features, aspects and advantages of the embodiments will become more apparent from the following detailed description.

Moreover, although some of the embodiments were primarily designed for well bore perforating, for example, they may also be used in other perforating scenarios or in other fields, as apparent to a person skilled in the art. For this reason, expressions such as "gun system", etc., as used herein should not be taken as to be limiting, and includes all other kinds of materials, objects and/or purposes with which the various embodiments could be used and may be useful. Each example or embodiment are provided by way of explanation, and is not meant as a limitation and does not constitute a definition of all possible embodiments.

In addition, although some of the embodiments are illustrated in the accompanying drawings comprise various components and although the embodiment of the adjustment system as shown consists of certain geometrical configurations as explained and illustrated herein, not all of these components and geometries are essential and thus should not be taken in their restrictive sense, i.e. should not be taken as to limit the scope. It is to be understood, as also apparent to a person skilled in the art, that other suitable components and cooperations thereinbetween, as well as other suitable geometrical configurations may be used for the adjustment systems, and corresponding parts, according to various embodiments, as briefly explained and as can easily be inferred herefrom by a person skilled in the art, without departing from the scope.

Figure 1:
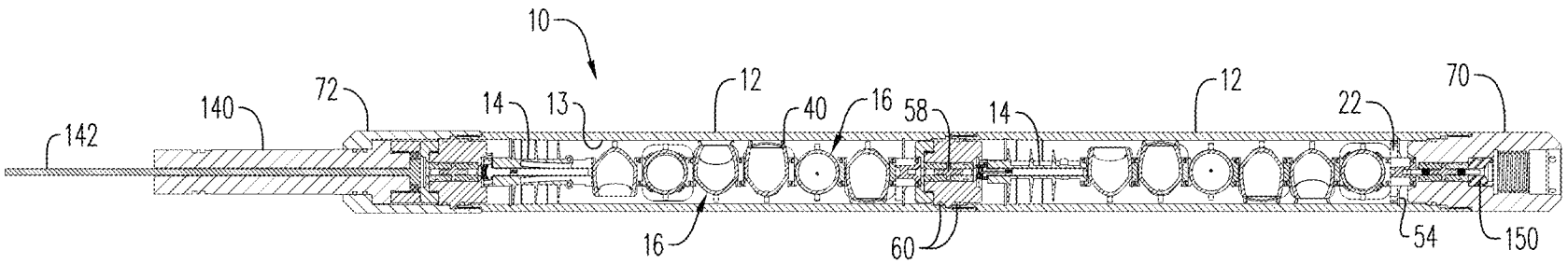
FIG. 1 is a side cut view of a perforation gun system according to an embodiment.
Figure 2:
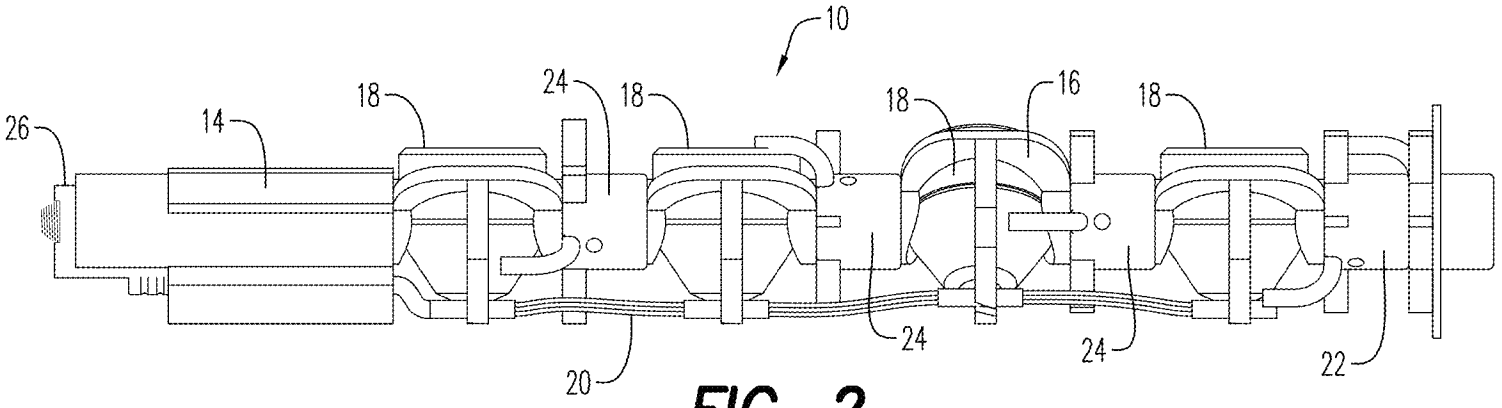
FIG. 2 is a side view of a top connector, bottom connector and stackable charge holders of a perforation gun system in accordance with another embodiment.
Figure 3:
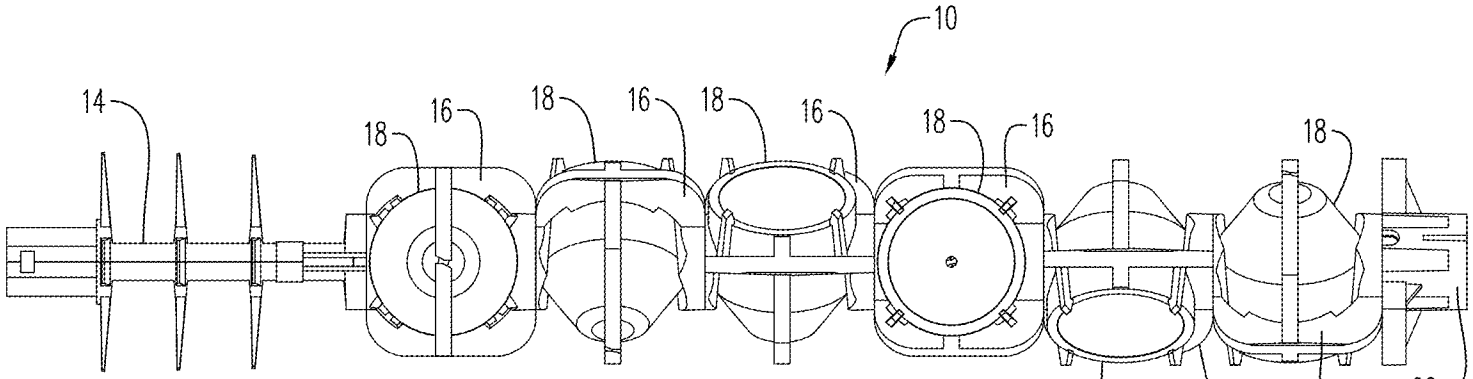
FIG. 3 is a side view of a top connector, bottom connector and stackable charge holders of a perforation gun system in accordance with another embodiment.
Figure 6:
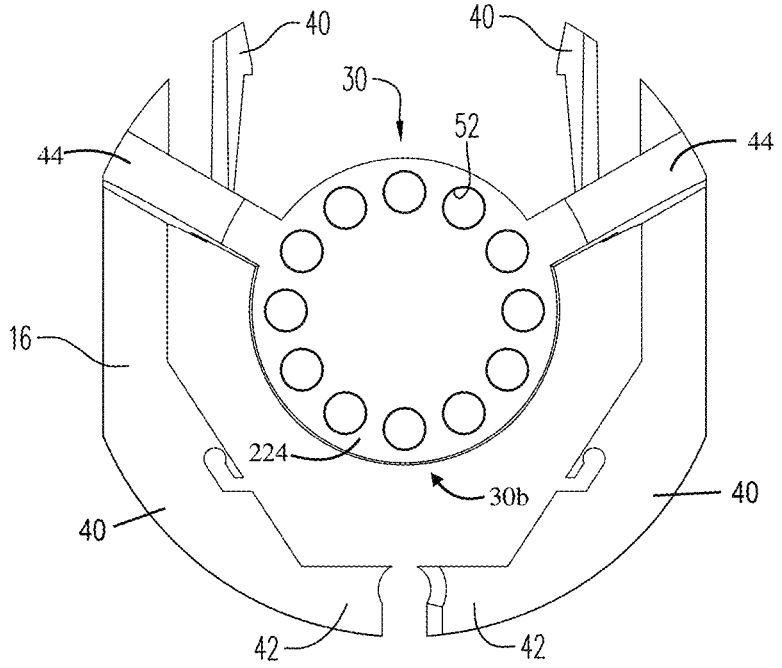
FIG. 6 is a front view of a stackable charge holder in accordance with an embodiment.
Figure 7:
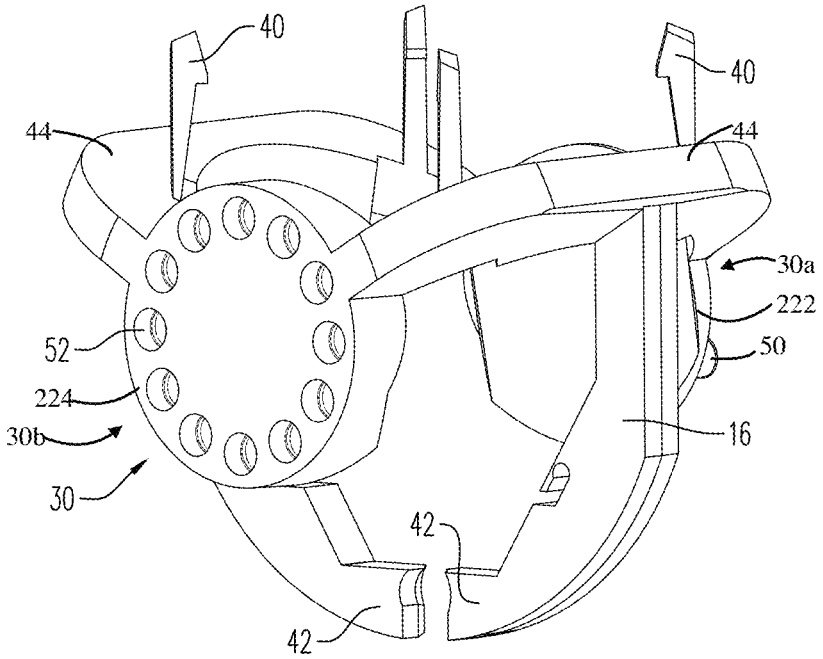
FIG. 7 is a front perspective view of the stackable charge holder shown in FIG. 6.
Figure 8:
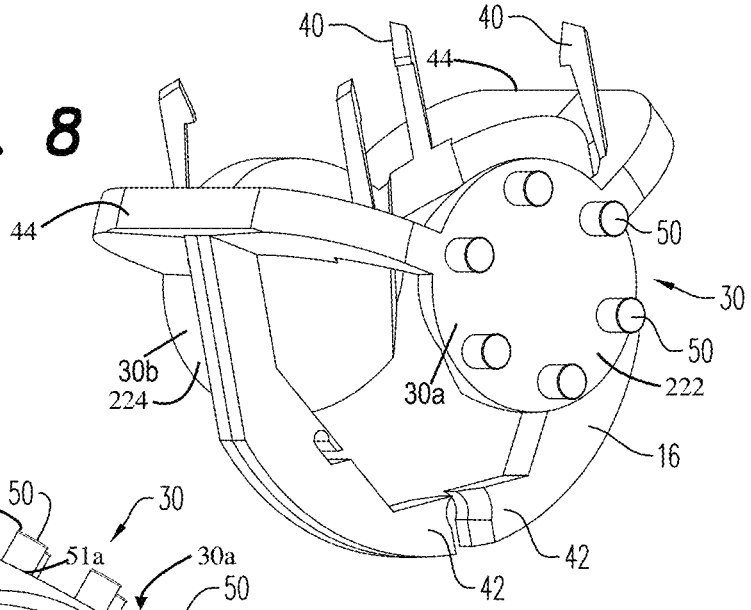
FIG. 8 is a rear perspective view of the stackable charge holder shown in FIG. 6.
Figure 9:
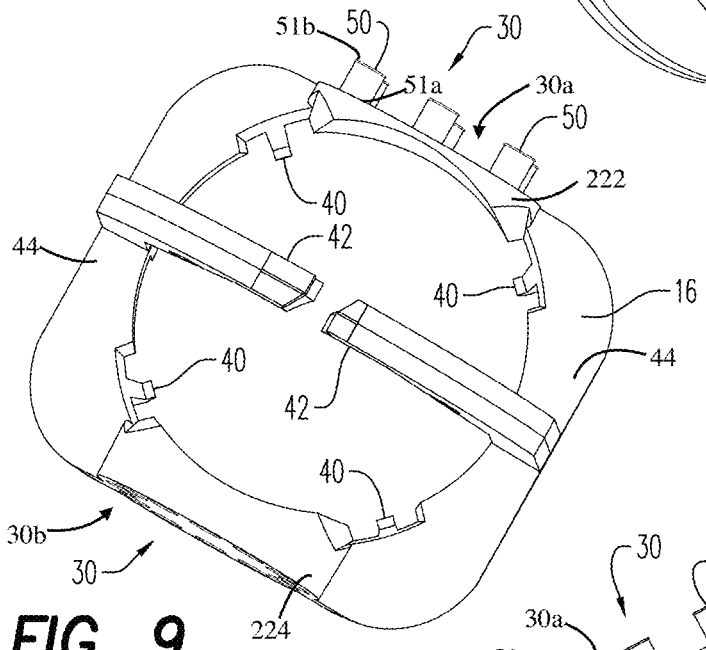
FIG. 9 is a bottom view of the stackable charge holder shown in FIG. 6.
Figure 10:
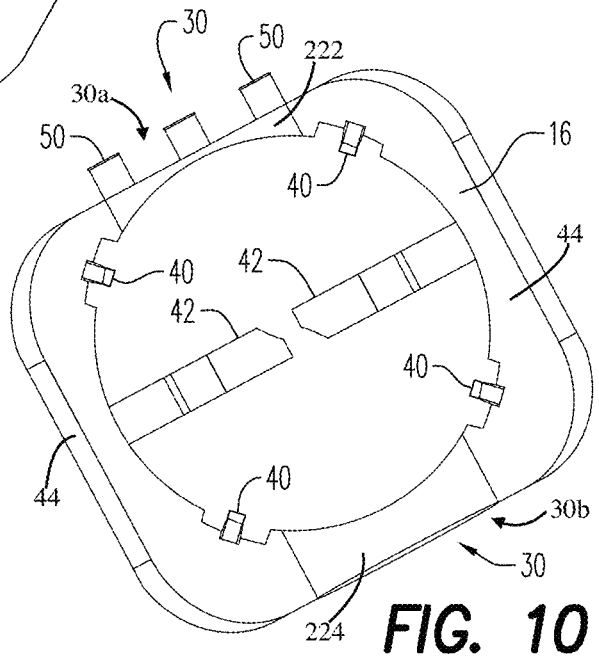
FIG. 10 is a top view of the stackable charge holder shown in FIG. 6.

Referring to FIGS. 1 to 3, an object is to provide a perforation gun system 10 having an outer gun carrier 12. The gun system 10 includes a top connector 14. At least one stackable charge holder 16 is provided for centralizing a single shaped charge 18 within the gun carrier 12. A detonation cord 20 is connected to the top connector 14 and to each stackable charge holder 16.

The gun system 10 includes at least one bottom connector 22 for terminating the detonation cord 20 in the gun system. As better shown in FIG. 2, it is also possible that the bottom connector 22 double as or serve the function of a spacer 24 for spacing a plurality of stackable charge holders 16.

In an embodiment, the gun system also includes a detonator 26 energetically coupled to the detonation cord 20.

As better shown in FIGS. 4 to 18, each of the top connector 14, stackable charge holder 16 and bottom connector 22 includes a rotation coupling 30 for providing a selectable clocking rotation between each of the above-mentioned components. As seen, for instance, in FIGS. 4-5 and 7-9, the rotation coupling 30 includes a first rotation coupling 30*a* and a second rotation coupling 30*b*.

Hence, a user can build multiple configurations of gun systems using various combinations of basic components. A first of these basic components includes a top connector. Another basic component is a single charge holder that centralizes a single shaped charge. The holder is adapted to be stacked and configured into 0, 30, 60, up to 360 degrees or any other combination of these phases for any specified length. Another basic component is a bottom connector that terminates the detonation cord in the gun. The bottom connector may carry as well an electrical connection therethrough. The bottom connector may also double as an imperial measurement stackable spacer to provide any gun shot density up to, for example, 6 shots per foot. Alternately, another bottom connector may be provided or configured to double as a metric measurement stackable spacer to provide any gun shot density up to, for example, 20 shots per meter. Another basic component includes a push-in detonator that does not use wires to make necessary connections. The push-in detonator may use spring-loaded connectors, thus replacing any required wires and crimping.

Therefore, within the self-centralizing charge holder system, any number of spacers can be used with any number of holders for any specific metric or imperial shot density, phase and length gun system.

In an embodiment, only two pipe wrenches are required for assembly on site of the gun system, as no other tools are required.

In an embodiment, the top connector 14 provides energetic coupling between the detonator and detonating cord.

In an embodiment, each of the top connector 14, stackable charge holder 16 and bottom connector 22 are configured to receive electrical connections therethrough.

In an embodiment, all connections are made by connectors, such as spring-loaded connectors, instead of wires, with the exception of the through wire that goes from the top connector 14 to the bottom connector 22, whose ends are connectors.

In an embodiment, components of the assembly may include molded parts, which may also be manufactured to house the wiring integrally, through, for instance, overmolding, to encase the wiring and all connectors within an injection molded part. For example, the charge holder 16 could be overmolded to include the through wire.

Figure 19:
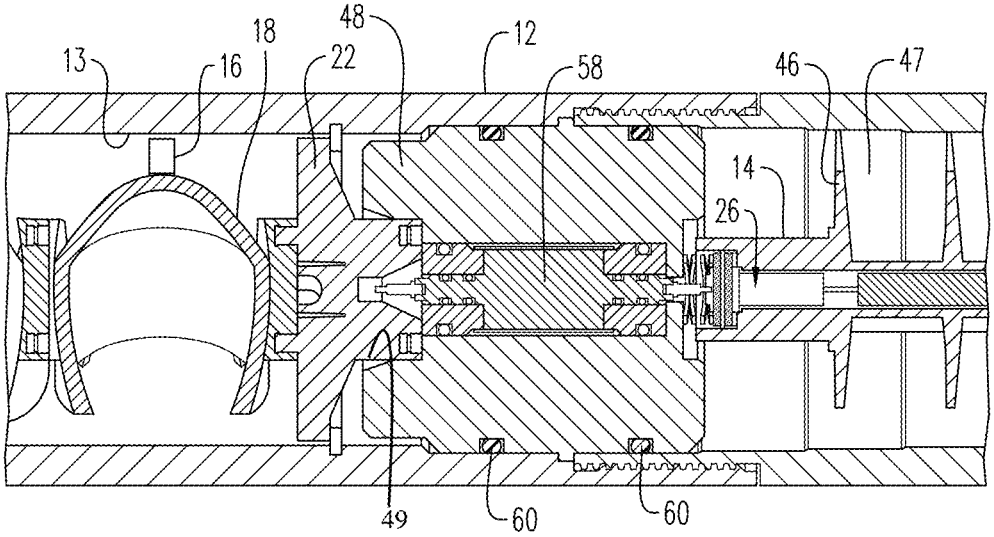
FIG. 19 is an enlarged detailed side cut view of a portion of the perforation gun system including a bulkhead and stackable charge holders shown in FIG. 1.

In an embodiment, and as shown in FIGS. 4 and 5, each bottom connector 22 includes a cylindrical body 220 comprising a first base 222 and a second base 224. The pins 50 outwardly extend from the first base 222, and the sockets 52 at least partially extend into the second base 224. As illustrated in FIGS. 4 and 5, each socket 52 is spaced apart from an adjacent socket and each pin 50 is spaced apart from an adjacent pin. The cylindrical body 220 may include a plurality of alternating v-shaped channels 221 and v-shaped walls 223. The v-shaped channels partially extend from the first base 222 towards the second base 224, and the v-shaped walls 223 extend from the second base 224 to the first base 222. At least one of the pins 50 of the rotation coupling 30 extend from one of the v-shaped walls 223. According to an aspect, when the bottom connector includes the first rotation coupling 30*a* and the second rotation coupling 30*b*, the cylindrical body 220 extends therebetween. The bottom connector 22 includes a plurality of fins/wings 32 radially extending from the body 220. The wings 32 are configured for axially locking each bottom connector against a snap ring 54, or an equivalent retainment mechanism to keep the charge holder 16 from sliding out of the bottom of carrier 12 as it is handled, (shown on FIG. 1). According to an aspect, and as illustrated in FIG. 19, the bottom connector 22 may be recessed into a recess 49 formed in the tandem seal adapter 48. The bottom connector 22 from a first gun assembly can accommodate or house an electrical connection through a bulkhead assembly 58 to the top connector 14 of a second or subsequent gun assembly, as seen for instance in FIG. 19. The top and bottom connector, as well as the spacer, in an embodiment, are made of 15% glass fiber reinforced, injection molding PA6 grade material, commercially available from BASF under its ULTRAMID® brand, and can provide a positive snap connection for any configuration or reconfiguration. As better shown in FIG. 5, a terminating means structure 34 is provided to facilitate terminating of the detonation cord. The structure 34 may be formed in the first base 222. The snap ring 54 is preinstalled on the bottom of the carrier 12. The assembly can thus shoulder up to the snap ring 54 via the bottom connector fins 32.

In an embodiment and as shown in FIGS. 6 to 10, each stackable charge holder 16 includes a charge receiving structure for receiving a single shaped charge, and a plurality of projections 40 extending from the charge receiving structure. The projections 40 may rest against an inner surface 13 or diameter of the gun carrier 12 (as shown in FIG. 1) and thereby centralizing the shaped charge therewithin. The charge receiving structure may include a pair of arms 44, and each projection 40 may extend from at least one of the arms 44. A pair 42 of the plurality of projections 40 may also be configured for capturing the detonation cord (not shown) traversing each stackable charge holder 16. The pair 42 of the plurality of projections are also used for centralizing the shaped charge within an inner surface of the gun carrier. According to an aspect, the stackable charge holder 15 includes a first base 222 and a second base 224 spaced apart from the first base 222. The arms 44 extend between the first and second bases 222, 224. According to an aspect, the pins 50 outwardly extend from the first base 222, and the sockets 52 at least partially extend into the second base 224. Each pin is spaced apart from an adjacent pin, and each socket 52 is spaced apart from an adjacent socket.

Figure 11:
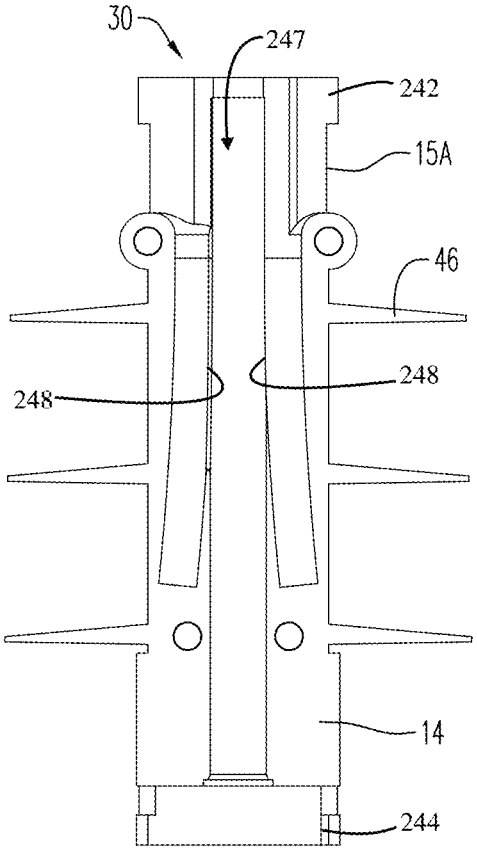
FIG. 11 is a bottom view of a half-portion of a top connector in accordance with an embodiment.
Figure 12:
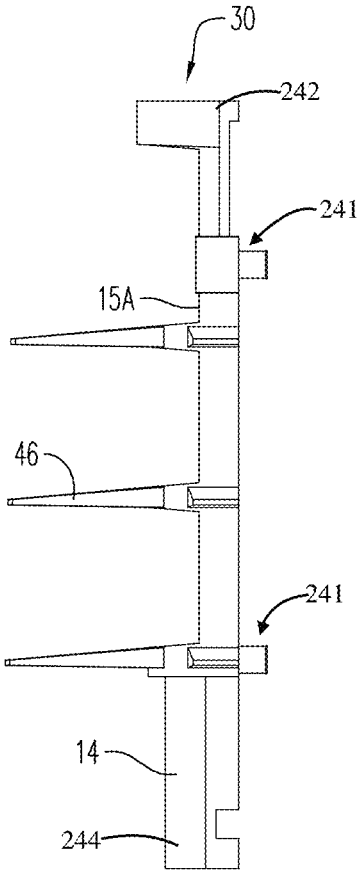
FIG. 12 is a side view of the half-portion of the top connector shown in FIG. 11.
Figure 13:
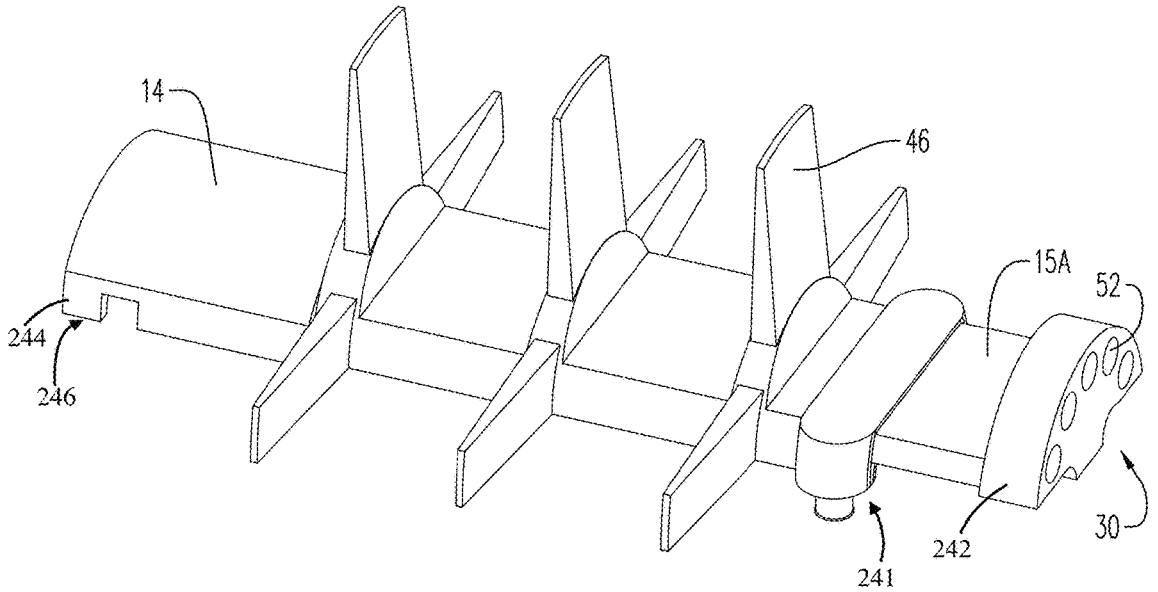
FIG. 13 is a top perspective view of the half-portion of the top connector shown in FIG. 11.
Figure 14:
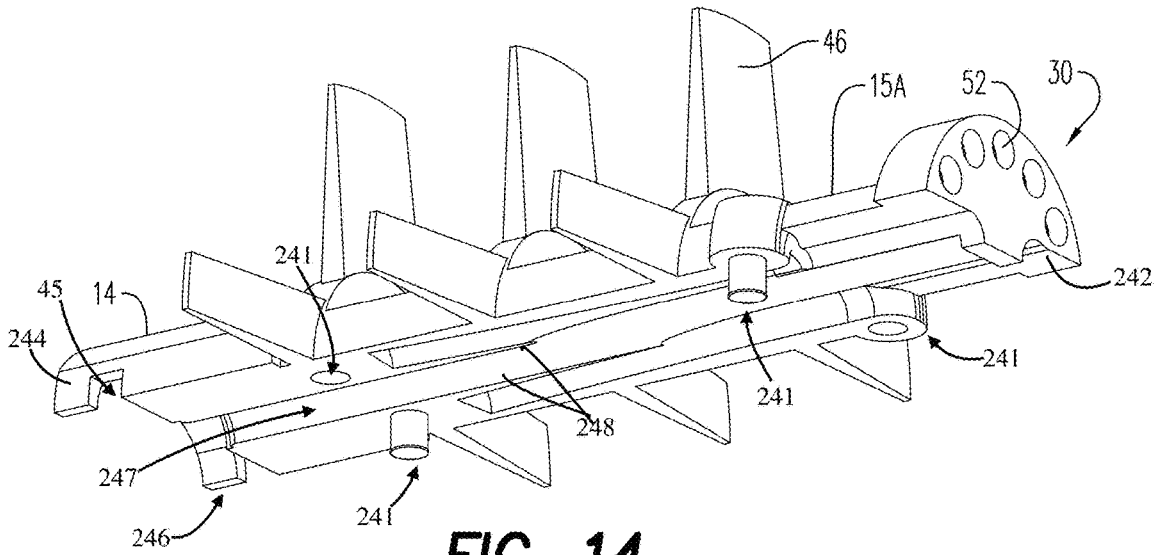
FIG. 14 is a bottom perspective view of the half-portion of the top connector shown in FIG. 11.
Figure 15:
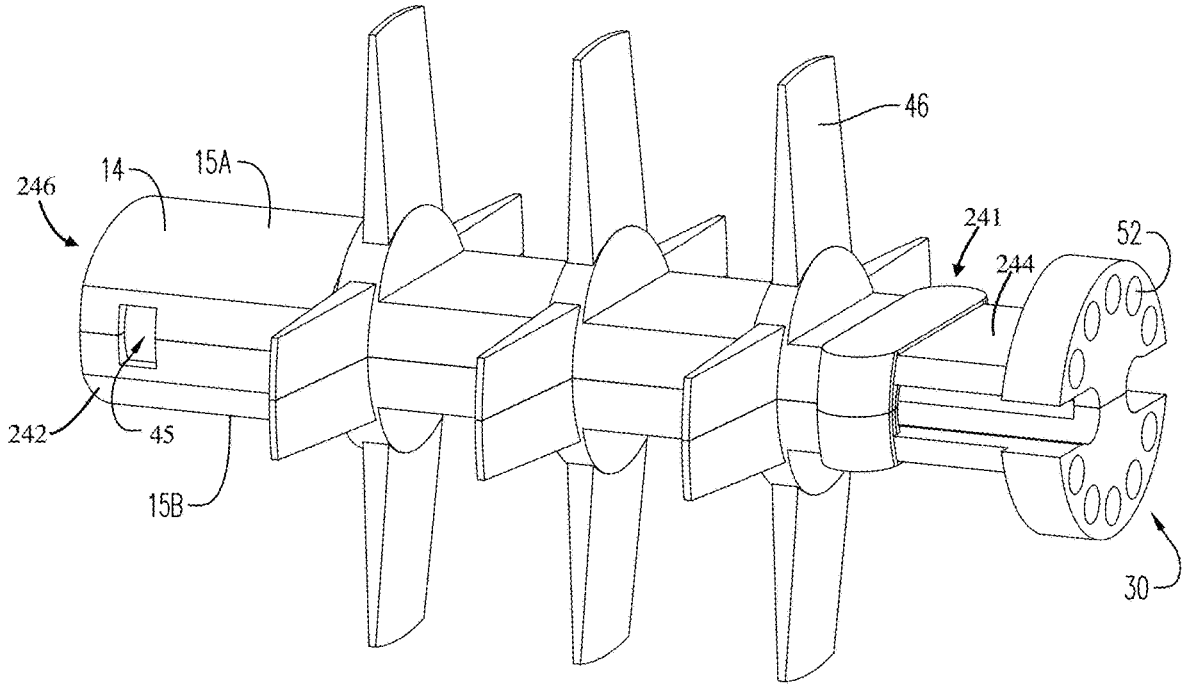
FIG. 15 is a perspective view of a top connector in accordance with an embodiment.
Figure 16:
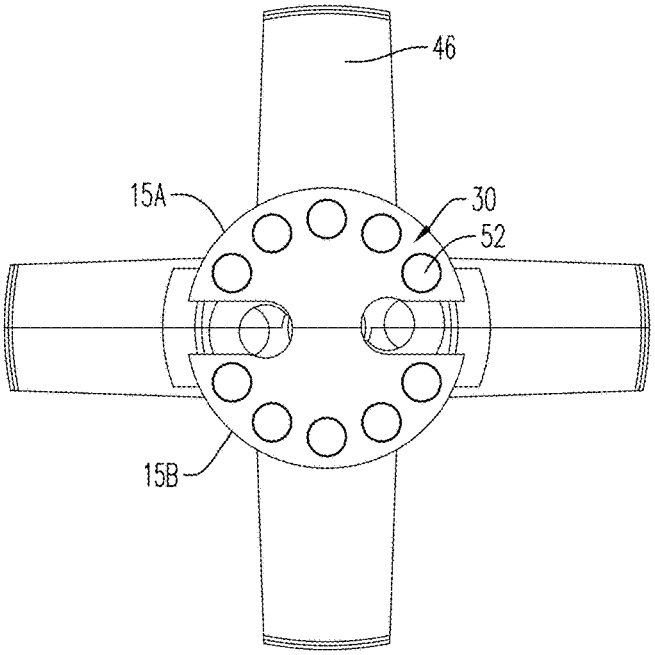
FIG. 16 is a front end view of the top connector shown in FIG. 15.
Figure 17:
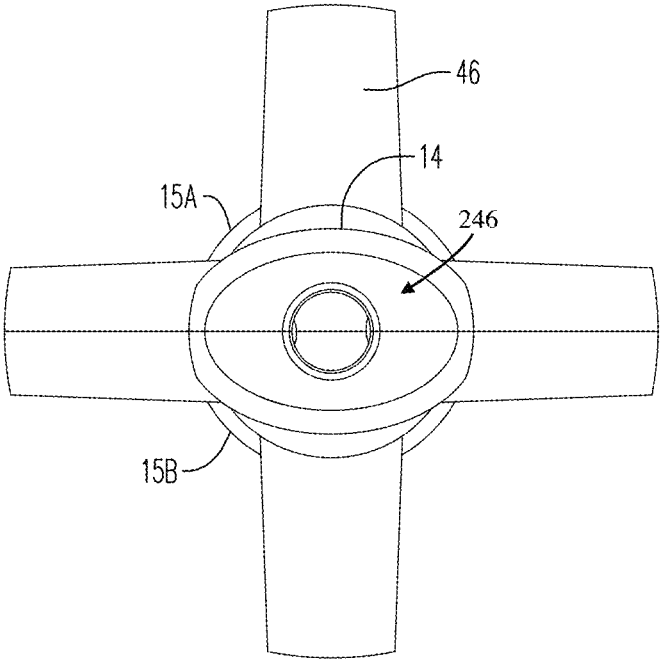
FIG. 17 is a rear end view of the top connector shown in FIG. 15.
Figure 18:
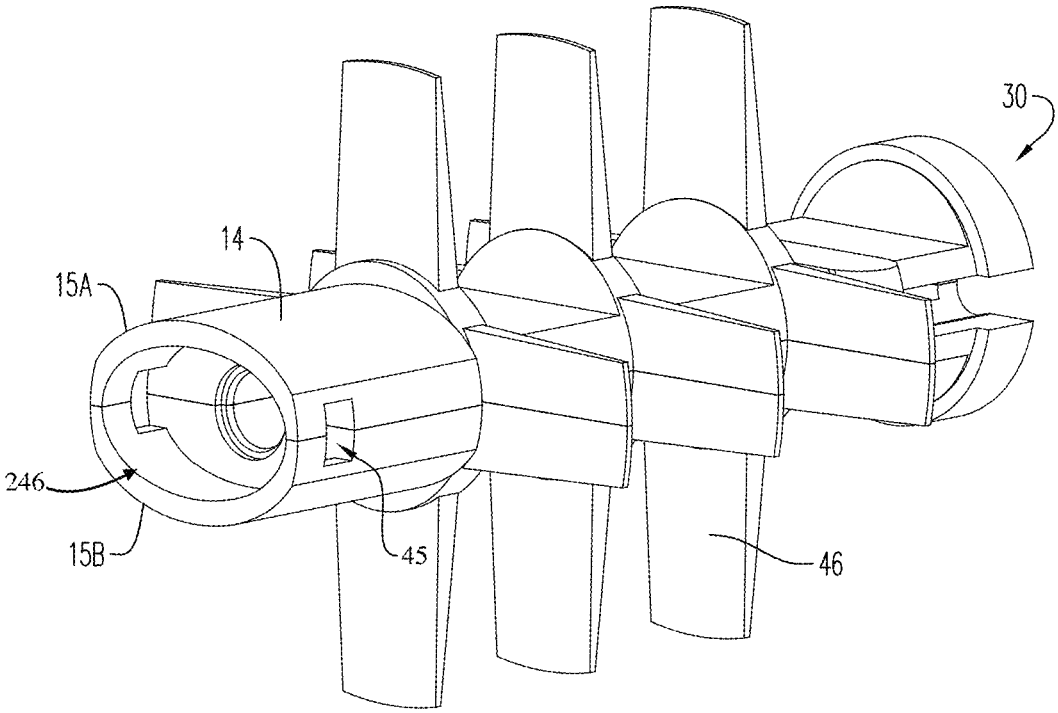
FIG. 18 is a rear perspective view of the top connector shown in FIG. 15.

In an embodiment, as shown in FIGS. 11 to 18, the top connector 14 includes a first end 242, a second end 244, and a coupler 246 formed at the first end 242. The top connector 14 may be configured for providing energetic coupling between the detonator 26 and a detonation cord. According to an aspect and as illustrated in FIGS. 11 and 14, an elongated opening 247 extends from the second end 244, adjacent the coupler 246, towards the first end 242. The elongated opening 247 is flanked by side walls 248 that provide the energetic coupling between the detonator 26 and the detonation cord 20. A rotation coupling 30 is formed at the second end 244. The rotation coupling includes at least one of a plurality of pins 50 and a plurality of sockets 52. According to an aspect, the top connector 14 includes at least one directional locking fin 46. Although the use of directional locking fins is described, other methods of directional locking may be used, in order to eliminate a top snap ring that would otherwise be used to lock the assembly. As better shown in FIG. 19, the locking fins 46 are engageable with corresponding complementarily-shaped structures 47 housed within the carrier 12, upon a rotation of the top connector 14, to lock the position of the top connector along the length of the carrier 12.

In an embodiment, as better shown in FIG. 19, the bottom connector 22 on one end and the top connector 14 on the other end abuts/connects to the bulkhead assembly 58. The tandem seal adapter 48 is configured to seal the inner components within the carrier 12 from the outside environment, using sealing means 60 (shown herein as o-rings). Thus, the tandem seal adapter 48 seals the gun assemblies from each other along with the bulkhead 58, and transmits a ground wire to the carrier 12. Hence, the top connector 14 and bulkhead 58 accommodate electrical and ballistic transfer to the charges of the next gun assembly for as many gun assembly units as required, each gun assembly unit having all the components of a gun assembly.

In an embodiment, the tandem seal adapter 48 is a two-part tandem seal adapter (not shown) that fully contains the bulkhead assembly 58 (comprised of multiple small parts as shown, for instance, in FIG. 19) and that is reversible such that it has no direction of installation.

In an embodiment and as better shown in FIGS. 27-31 and 35A, the detonator assembly 26 includes a detonator head 100, a detonator body 102 and a plurality of detonator wires 104, including a through wire 106, a signal-in wire 108 and a ground wire 110. The through wire 106 traverses from the top to the bottom of the perforating gun system 10, making a connection at each charge holder 16. The detonator head 100 further includes a through wire connector element 112 connected to the through wire 106 (not shown), a ground contact element 114 for connecting the ground wire 110 to the tandem seal adapter (also not shown), through ground springs 116, and a bulkhead connector element 118 for connecting the signal-in wire 108 to the bulkhead assembly 58 (also not shown). Different insulating elements 120A, 120B are also provided in the detonator head 100 for the purpose of insulating the detonator head 100 and detonator wires 104 from surrounding components. As better shown in FIG. 31, a crimp sleeve 122 can be provided to cover the detonator head 100 and body 102, thus resulting in a more robust assembly. The above configuration allows the detonator to be installed with minimal tooling and wire connections.

Figure 32:
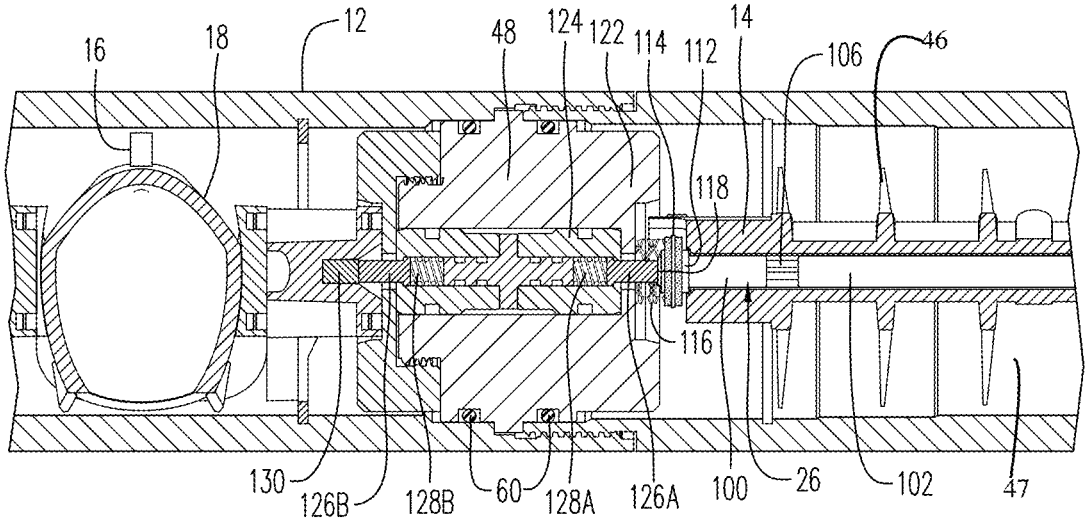
FIG. 32 is a detailed side view of a tandem seal adapter and detonator in accordance with another embodiment.
Figure 33:
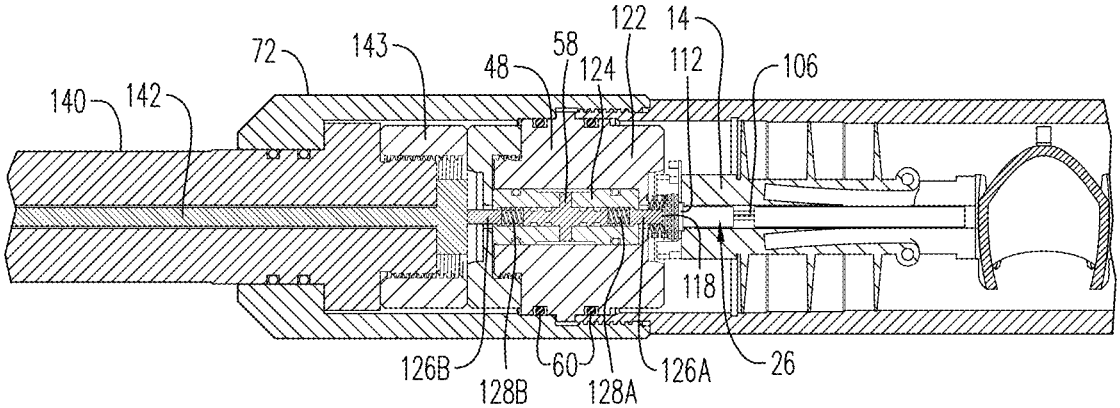
FIG. 33 is a side cut view of a portion of a perforation gun system illustrating the configuration of the top sub in accordance with another embodiment.
Figure 35A:
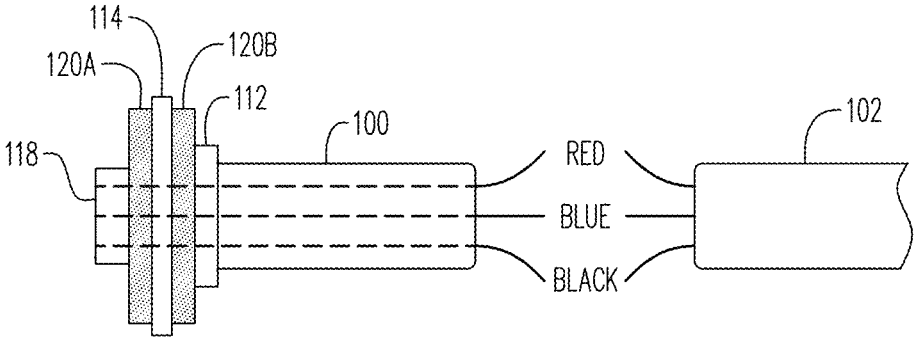
FIGS. 35A and 35B are electrical schematic views of a detonator and of wiring within a perforated gun system in accordance with another embodiment.
Figure 35B:
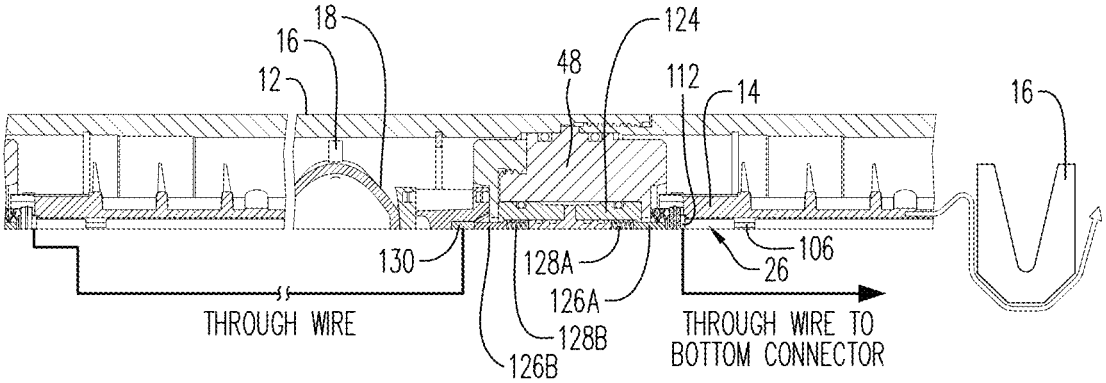

In an embodiment as shown in FIGS. 32, 33 and 35B illustrate a connection of the above-described detonator assembly 26 to the tandem seal adapter 48 and a pressure bulkhead 124. The bulkhead 124 includes spring connector end interfaces comprising contact pins 126A, 126B, linked to coil springs 128A, 128B. This dual spring pin connector assembly including the bulkhead 124 and coil springs 128A, 128B is positioned within the tandem seal adapter 48 extending from a conductor slug 130 to the bulkhead connector element. The dual spring pin connector assembly is connected to the through wire 106 of the detonator assembly 26.

In an embodiment and as better shown in FIGS. 11 to 18, the top connector 14 may have a split design to simplify manufacturing and aid in assembly. By "split design" what is meant is that the top connector 14 can be formed of two halves—a top half 15A and a bottom half 15B. A plurality of securing mechanisms 241 may be provided to couple the top half 15A to the bottom half 15B. As better shown in FIG. 15 or 18, the top connector 14 may also include a blind hole 45 to contain or house the detonation cord, thus eliminating the need for crimping the detonation cord during assembly.

In an embodiment and as shown for example in FIGS. 4 to 18, the rotation coupling 30 may either include a plurality of pins 50 (FIG. 5) symmetrically arranged about a central axis of the rotation coupling 30, or a plurality of sockets 52 (FIG. 4) symmetrically arranged about the central axis of the rotation coupling 30 and configured to engage the plurality of pins 50 of an adjacent rotation coupling 30. The pins each include a first end 51*a*, and a second end 51*b* opposite the first end 51*a*. According to an aspect, the second end 51*b* is wider than the first end 51*a*.

In another embodiment, the rotation coupling 30 may either include a polygon-shaped protrusion, or a polygon-shaped recess configured to engage the polygon-shaped protrusion of an adjacent rotation coupling. The polygon can be 12-sided for example for 30 degree increments.

In another embodiment, the top and bottom subs work with off the shelf running/setting tools as would be understood by one of ordinary skill in the art.

In one embodiment and as shown in FIG. 33, the top sub 72 facilitates use of an off the shelf quick change assembly 140 to enable electrical signals from the surface, as well as to adapt perforating gun system to mechanically run with conventional downhole equipment. The quick change assembly 140 may include a threaded adapter 143 to set an offset distance between an electrical connector 142 and the contact pin 126B extending from the bulkhead assembly 58.

Figure 34:
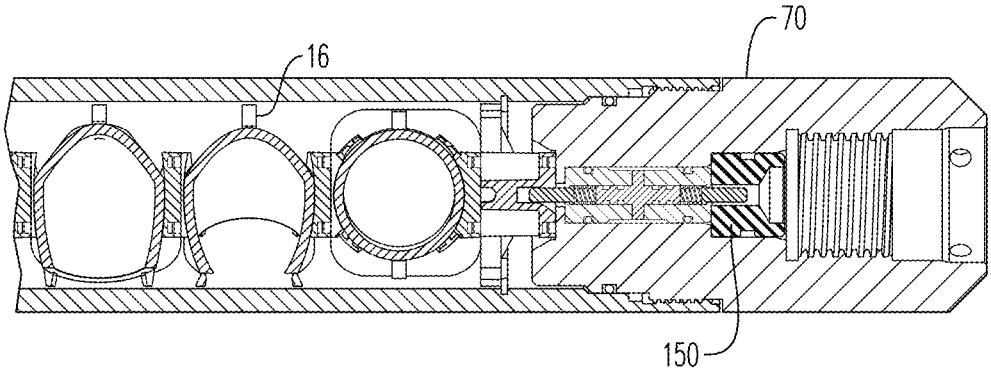
FIG. 34 is a side cut view of a portion of a perforation gun system illustrating the configuration of the bottom sub in accordance with another embodiment.

In one embodiment and as shown in FIG. 34, the bottom sub 70 may be configured as a sealing plug shoot adapter (SPSA) to be used specifically with this embodiment. The SPSA may receive an off the shelf quick change assembly 140 (not shown) and insulator 150 that communicates with a firing head threaded below it (not shown). A setting tool (not shown) may run on the bottom side of the perforating gun.

In an embodiment, final assembly of the tool string requires only two pipe wrenches. No tools are required to install the detonator or any electrical connections.

An object is to also provide a perforation gun system kit having the basic component parts described above and capable of being assembled within an outer gun carrier.

Figure 21:
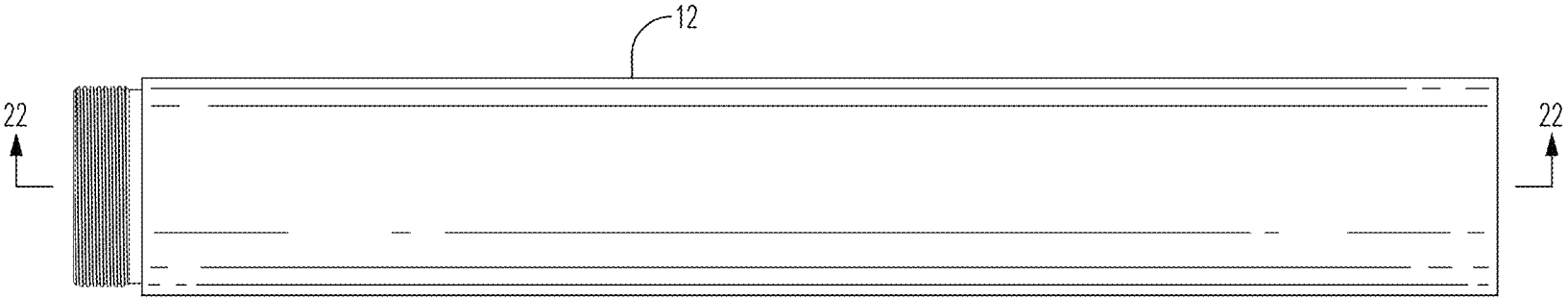
FIG. 21 is a side view of a gun carrier of a gun system in accordance with an embodiment.
Figure 22:
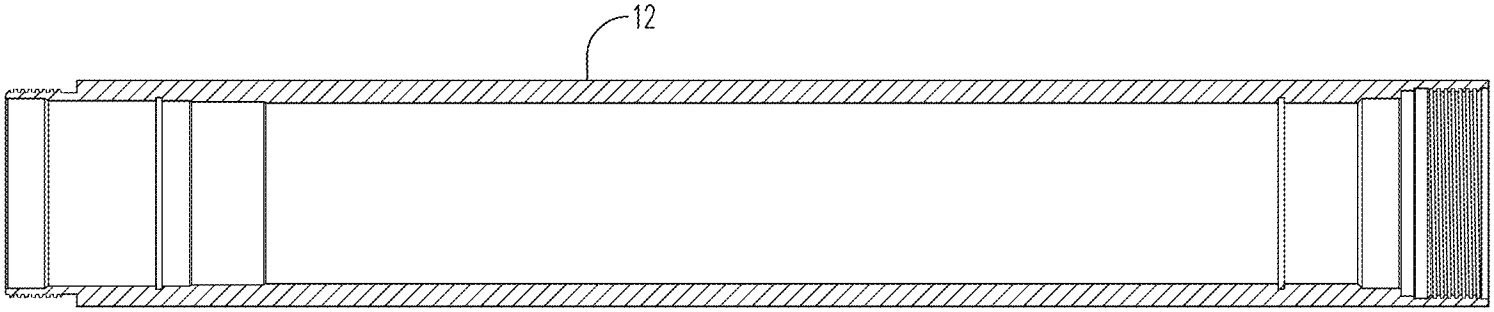
FIG. 22 is a side cut view of the gun carrier shown in FIG. 21.

In an embodiment, a method for assembling a perforation gun system is provided, to which a certain number of optional steps may be provided. The steps for assembling the gun system for transport include the steps of:

providing a perforation gun system kit having component parts capable of being assembled within an outer gun carrier (element 12 in FIGS. 1, 21 and 22), the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the through wire goes from the top connector to the bottom connector;

clicking the detonation cord into recesses formed in capturing projections, the capturing projections being provided in each of the charge holders;

running the detonation cord into the top connector;

cutting the detonating cord if the detonating cord is not precut a predetermined length; and installing charges into each of the charge holders.

In an embodiment, the method further includes, prior to transport, the steps of:

pushing assembled components together to engage all pin connections therebetween; and carrying out a continuity test to ensure complete connectivity of the detonating chord.

Figure 20:
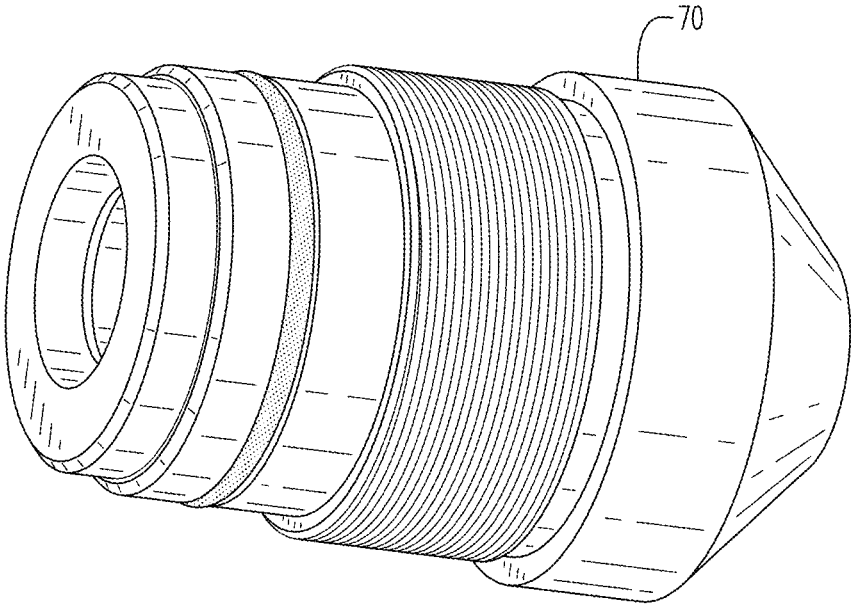
FIG. 20 is a perspective view of a bottom sub of a gun system in accordance with an embodiment.
Figure 23:
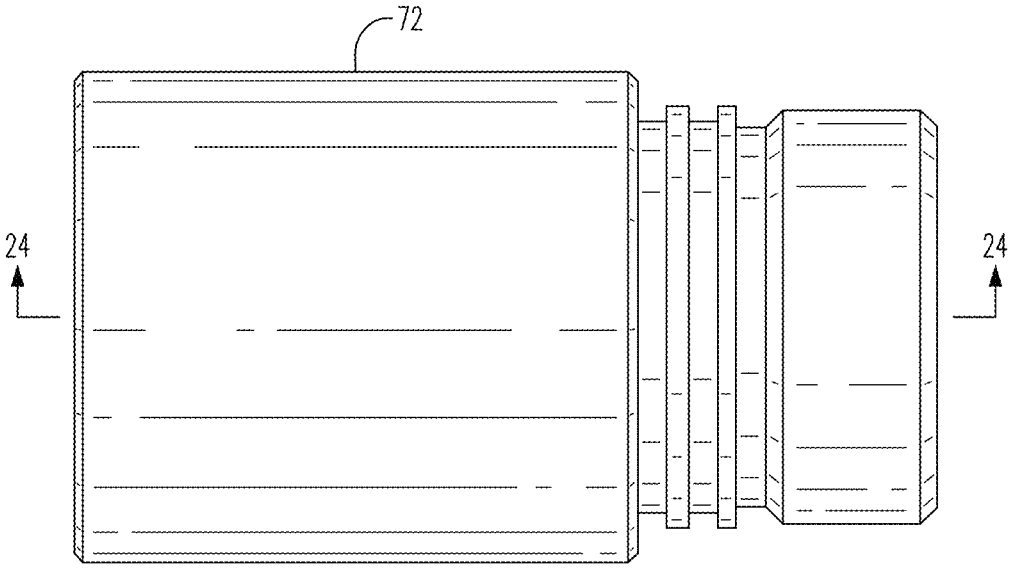
FIG. 23 is a side view of a top sub of a gun system in accordance with an embodiment.
Figure 24:
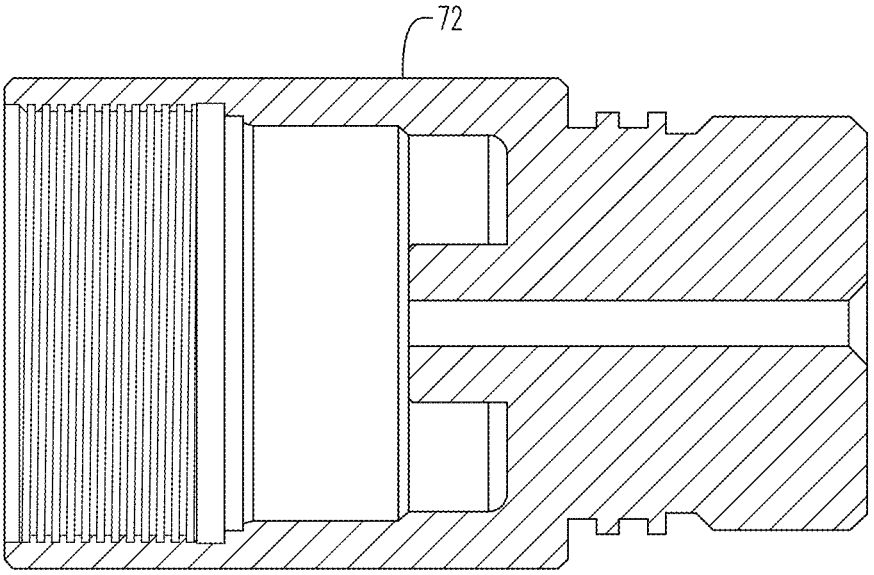
FIG. 24 is a side cut view of the top sub shown in FIG. 23.
Figure 25:
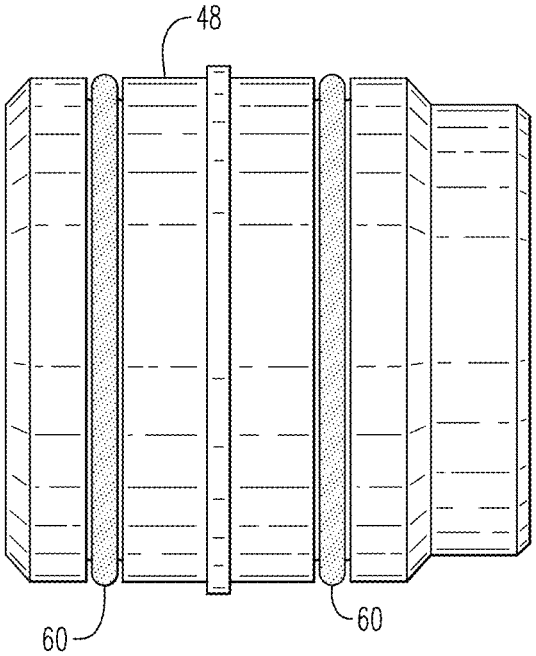
FIG. 25 is a side view of a tandem seal adapter of a gun system in accordance with an embodiment.
Figure 26:
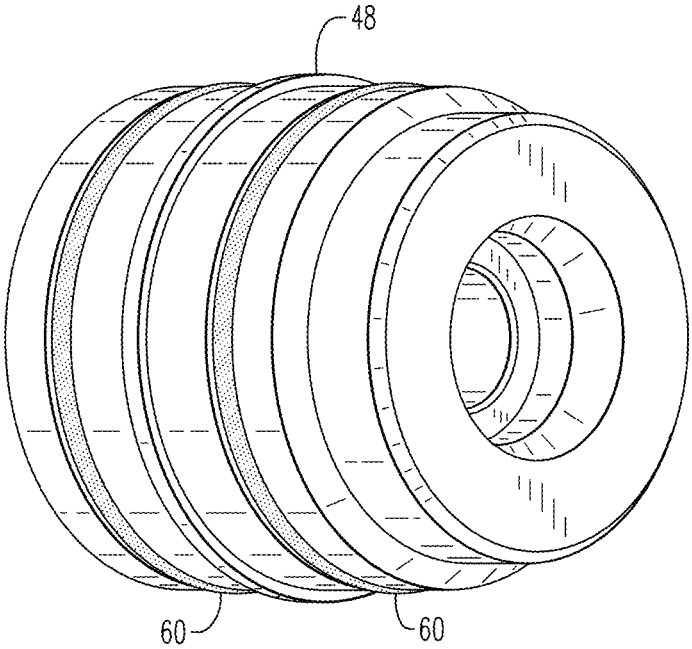
FIG. 26 is a perspective view of the tandem seal adapter shown in FIG. 25.
Figure 27:
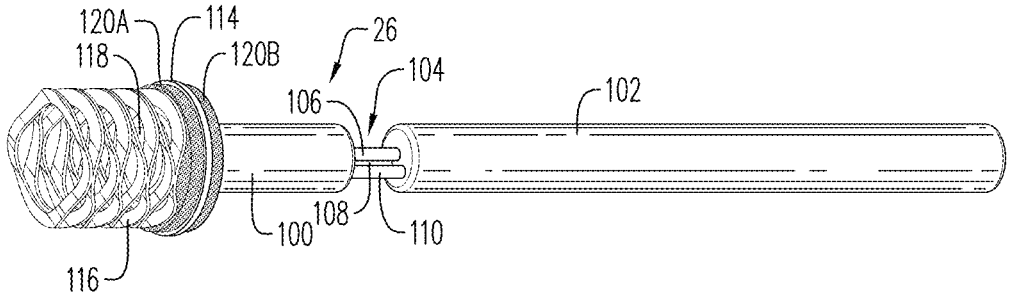
FIG. 27 is a perspective view of a detonator in accordance with an embodiment.
Figure 28:
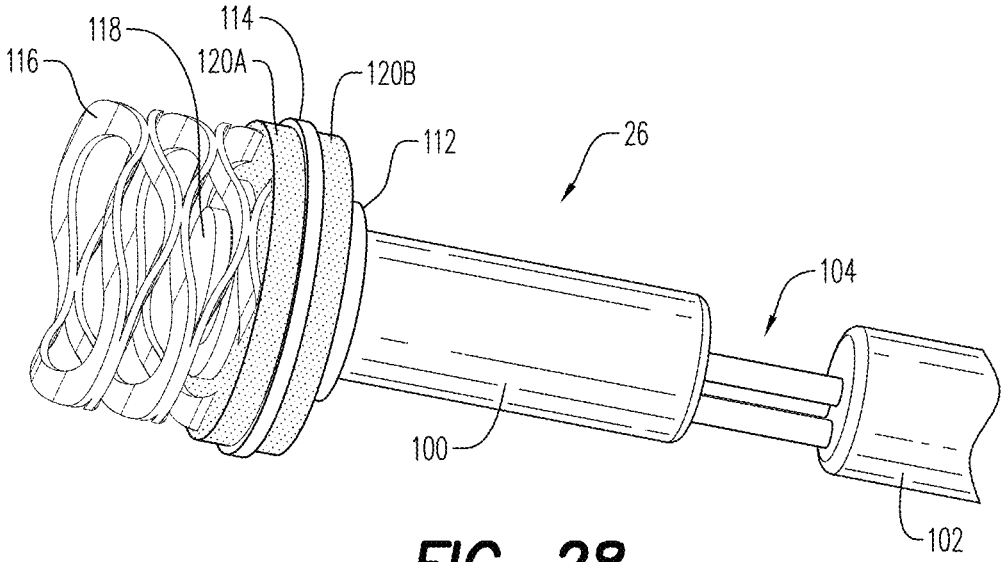
FIG. 28 is a detailed perspective view of the detonator shown in FIG. 27.
Figure 31:
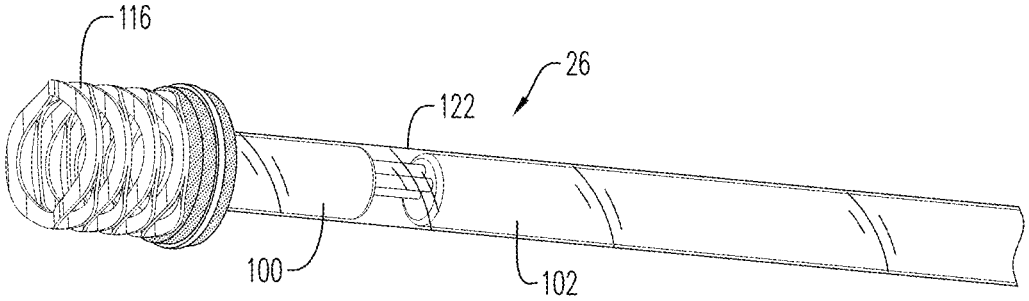
FIG. 31 is another detailed perspective view of the detonator shown in FIG. 27, with a crimp sleeve.

In an embodiment, on location, to complete the assembly, the method further comprises the steps of threading on the previously assembled components a bottom sub (element 70 on FIGS. 1 and 20);

installing and connecting the detonator;

pushing in a tandem seal adapter with o-rings onto the first gun assembly;

pushing in a bulkhead (element 58 in FIG. 19) onto the tandem seal adapter, if the bulkhead and the tandem seal adapter are not pre-assembled;

threading a subsequent gun assembly onto the first gun assembly or threading a top sub (element 72 in FIGS. 1, 23 and 24) onto a topmost assembled gun assembly, for connection to a quick change assembly.

Of course, the scope of the perforation gun system, various perforation gun components, the perforation gun system kit, and the method for assembling a perforation gun system should not be limited by the various embodiments set forth herein, but should be given the broadest interpretation consistent with the description as a whole. The components and methods described and illustrated are not limited to the specific embodiments described herein, but rather, features illustrated or described as part of one embodiment can be used on or in conjunction with other embodiments to yield yet a further embodiment. Further, steps described in the method may be utilized independently and separately from other steps described herein. Numerous modifications and variations could be made to the above-described embodiments without departing from the scope of the FIGS. and claims, as apparent to a person skilled in the art.

In this specification and the claims that follow, reference will be made to a number of terms that have the following meanings. The singular forms "a," "an" and "the" include plural referents unless the context clearly dictates otherwise. Further, reference to "top," "bottom," "front," "rear," and the like are made merely to differentiate parts and are not necessarily determinative of direction. Similarly, terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the perforation gun system, various perforation gun components, the perforation gun system kit, and the method for assembling a perforation gun system, including the best mode, and also to enable any person of ordinary skill in the art to practice same, including making and using any devices or systems and performing any incorporated methods. The patentable scope of the perforation gun system, various perforation gun components, the perforation gun system kit, and the method for assembling a perforation gun system is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A charge holder for use with a shaped charge, the charge holder comprising:

a charge receiving structure configured to receive the shaped charge;

a plurality of projections extending from the charge receiving structure and configured to retain the shaped charge within the charge receiving structure; and a rotation coupling configured to couple and orient the charge holder rotationally to an adjacent charge holder having an adjacent rotation coupling, by connecting the rotation coupling to the adjacent rotation coupling.

2. The charge holder for use of claim 1, wherein each projection of the plurality of projections comprises:

a first end coupled to the charge receiving structure; and a hook portion provided at a second end opposite to the first end.

3. The charge holder for use of claim 2, wherein each hook portion is configured to couple to the shaped charge.

4. The charge holder for use of claim 3, wherein each hook portion couples to a top edge of the shaped charge.

5. The charge holder for use of claim 1, wherein the rotation coupling is configured to permit a selectable relative rotation angle between the charge holder and the adjacent charge holder.

6. A charge holder assembly for use in a perforating gun, the charge holder assembly comprising:

a first charge holder comprising:

a first charge receiving structure configured to receive a first shaped charge;

a first plurality of projections extending from the first charge receiving structure and configured to retain the first shaped charge within the first charge receiving structure; and a first rotation coupling; and a second charge holder coupled to the first charge holder, the second charge holder comprising:

a second charge receiving structure configured to receive a second shaped charge;

a second plurality of projections extending from the second charge receiving structure and configured to retain the second shaped charge within the second charge receiving structure; and a second rotation coupling; wherein the first rotation coupling is connected and rotationally oriented to the second rotation coupling such that the first charge holder is rotationally oriented with respect to the second charge holder.

7. The charge holder assembly of claim 6, wherein:

the first shaped charge is aimed in a first direction;

the second shaped charge is aimed in a second direction;

the first rotation coupling is configured to couple to the second rotation coupling such that an angle between the first direction and the second direction varies as the first charge holder rotates with respect to the second charge holder.

8. The charge holder assembly of claim 6, wherein:

each projection of the first plurality of projections and the second plurality of projections comprises:

a first end coupled to the respective charge receiving structure; and a hook portion provided at a second end opposite to the first end.

9. The charge holder assembly of claim 8, wherein:

each hook portion of the first plurality of projections and the second plurality of projections is configured to couple to the respective shaped charge.

10. The charge holder assembly of claim 9, wherein:

wherein each hook portion couples to a top edge of the respective shaped charge.

11. A perforating gun comprising:

a gun carrier;

a charge holder assembly provided within the gun carrier, the charge holder assembly comprising:

a first charge holder comprising:

a first charge receiving structure configured to receive a first shaped charge;

a first plurality of projections extending from the first charge receiving structure and configured to retain the first shaped charge within the first charge receiving structure; and a first rotation coupling;

a second charge holder coupled to the first charge holder, the second charge holder comprising:

a second charge receiving structure configured to receive a second shaped charge;

a second plurality of projections extending from the second charge receiving structure and configured to retain the second shaped charge within the second charge receiving structure; and a second rotation coupling; wherein the first rotation coupling is connected and rotationally oriented to the second rotation coupling such that the first charge holder is rotationally oriented with respect to the second charge holder;

a detonating cord energetically coupled to each of the first shaped charge and the second shaped charge; and a detonator energetically coupled to the detonating cord.

12. The perforating gun of claim 11, wherein:

the first shaped charge is aimed in a first direction;

the second shaped charge is aimed in a second direction;

the first rotation coupling is configured to connect to the second rotation coupling such that an angle between the first direction and the second direction varies as a rotational orientation of the first charge holder varies with respect to the second charge holder.

13. The perforating gun of claim 11, wherein:

each projection of the first plurality of projections comprises:

a first end coupled to the first charge receiving structure; and a hook portion provided at a second end opposite to the first end; and each projection of the second plurality of projections comprises:

a first end coupled to the second charge receiving structure; and a hook portion provided at a second end opposite to the first end.

14. The perforating gun of claim 13, wherein:

each hook portion of the first plurality of projections is configured to couple to the first shaped charge; and each hook portion of the second plurality of projections is configured to couple to the second shaped charge.

15. The perforating gun of claim 11, further comprising:

a first recess configured to receive the detonating cord proximate to the first shaped charge; and a second recess configured to receive the detonating cord proximate to the second shaped charge.

16. The perforating gun of claim 11, further comprising a top connector coupled to the first charge holder opposite the second charge holder, the top connector being configured to receive the detonator and a first end of the detonating cord.

17. The perforating gun of claim 16, wherein:

the first charge holder further comprises a third rotation coupling opposite the first rotation coupling;

the top connector further comprises a fourth rotation coupling; and the third rotation coupling is coupled to the fourth rotation coupling such that the first charge holder is rotatable with respect to the top connector.

18. The perforating gun of claim 11, further comprising a bottom connector coupled to the second charge holder opposite the first charge holder.

19. The perforating gun of claim 18, wherein:

the second charge holder further comprises a third rotation coupling opposite the second rotation coupling;

the bottom connector further comprises a fourth rotation coupling; and the third rotation coupling is coupled to the fourth rotation coupling such that the second charge holder is rotatable with respect to the bottom connector.

20. The perforating gun of claim 11, further comprising:

a top connector coupled to a first end of the charge holder assembly and configured to receive the detonator;

a bottom connector coupled to a second end of the charge holder assembly;

an electrical connection in electrical communication with the detonator and extending through the top connector, the charge holder assembly, and the bottom connector.

* * * * *